US011344071B2

(12) United States Patent
Hoffman et al.

(10) Patent No.: US 11,344,071 B2
(45) Date of Patent: May 31, 2022

(54) ANATOMY SHADING FOR GARMENTS

(71) Applicants: VF Corporation, Greensboro, NC (US); The Regents of The University of California, Oakland, CA (US)

(72) Inventors: Donald D. Hoffman, Irvine, CA (US); Darren Peshek, Ladera Ranch, CA (US); Stephen Frederick Dull, Greensboro, NC (US); Stephen Harilaos Zades, Winston Salem, NC (US); Robin O'Neill Fisher, Atlanta, GA (US)

(73) Assignee: The H.D. Lee Company, Inc., Greensboro, NC (US)

( * ) Notice: Subject to any disclaimer, the term of this patent is extended or adjusted under 35 U.S.C. 154(b) by 0 days.

(21) Appl. No.: 16/660,375

(22) Filed: Oct. 22, 2019

(65) Prior Publication Data

US 2020/0046039 A1 Feb. 13, 2020

Related U.S. Application Data

(62) Division of application No. 14/517,339, filed on Oct. 17, 2014, now abandoned.

(60) Provisional application No. 61/892,749, filed on Oct. 18, 2013.

(51) Int. Cl.
*A41D 1/06* (2006.01)

(52) U.S. Cl.
CPC ..... *A41D 1/06* (2013.01); *A41D 2400/38* (2013.01)

(58) Field of Classification Search
CPC .. A41D 1/06; A41D 2400/38; A41D 2400/82; A41D 2500/54
USPC ..... 2/69
See application file for complete search history.

(56) References Cited

U.S. PATENT DOCUMENTS

| | | | |
|---|---|---|---|
| 259,820 | A | 6/1882 | Cohef |
| 263,766 | A | 9/1882 | Wright et al. |
| 278,376 | A | 5/1883 | Trull |
| 278,377 | A | 5/1883 | Van Liew |
| 278,471 | A | 5/1883 | Tuenee |
| 407,024 | A | 7/1889 | Miller |
| 483,924 | A | 10/1892 | Thom |
| 528,742 | A | 11/1894 | Schmid |
| 532,958 | A | 1/1895 | Hickok |
| 558,954 | A | 4/1896 | Hopkins |
| 564,373 | A | 7/1896 | Goodman |
| 584,487 | A | 6/1897 | Thom |

(Continued)

FOREIGN PATENT DOCUMENTS

| | | |
|---|---|---|
| CN | 1063031 A | 7/1992 |
| CN | 3546110 | 7/2006 |

(Continued)

OTHER PUBLICATIONS

Translation FR2876880B3 Claims—English (Year: 2006).*

(Continued)

*Primary Examiner* — Alissa J Tompkins
*Assistant Examiner* — Catherine M Ferreira
(74) *Attorney, Agent, or Firm* — Womble Bond Dickinson (US) LLP

(57) ABSTRACT

In one embodiment, a garment includes a garment substrate and a pattern formed on the substrate that emulates the contours of an ideally proportioned body so as to give observers the impression of the ideal proportions.

9 Claims, 14 Drawing Sheets

(56) References Cited

U.S. PATENT DOCUMENTS 586,084 A 7/1897 Duryea
592,829 A 11/1897 Richardson
600,882 A 3/1898 Martin
650,154 A 5/1900 Owens
686,800 A 11/1901 Barry
693,276 A 2/1902 Klavinsky
732,801 A 7/1903 Turner
733,398 A 7/1903 Joseph
735,973 A 8/1903 Harsha
758,695 A 5/1904 Riotte
758,696 A 5/1904 Ross
762,072 A 6/1904 Lord
764,755 A 7/1904 McManigal
768,359 A 8/1904 Eisenhuth
770,728 A 9/1904 Madden
793,033 A 6/1905 Kitsee
802,256 A 10/1905 Bamberger et al.
1,041,012 A 10/1912 Burke
1,282,609 A 10/1918 Macomber
1,654,064 A 12/1927 Zaki
1,697,255 A 1/1929 Wolff
1,817,053 A 8/1931 Zerk
1,852,138 A 4/1932 Zerk
D119,122 S 2/1940 Bauer
2,381,580 A 8/1945 Einbinder
2,462,361 A 2/1949 Cassens
D153,438 S 4/1949 Kratz
2,715,226 A 8/1955 Weiner
2,718,640 A 9/1955 Suckle
2,840,824 A 7/1958 Horner
3,175,560 A 3/1965 Menzies
3,589,366 A 6/1971 Feather
3,683,419 A 8/1972 Lewis
3,691,971 A 9/1972 Clarke
3,696,845 A 10/1972 Acker et al.
3,996,622 A 12/1976 Cooke
4,034,578 A 7/1977 Conti
4,230,114 A 10/1980 Feather
4,275,468 A 6/1981 Outlaw
D259,820 S 7/1981 Heinfling
4,282,609 A 8/1981 Freedman et al.
D263,766 S 4/1982 Heinfling
D267,674 S 1/1983 Livernois
D278,376 S 4/1985 Heinfling
D278,377 S 4/1985 Heinfling
D278,471 S 4/1985 Heinfling
D281,541 S 12/1985 Kerr
4,646,366 A 3/1987 Nishida et al.
D289,941 S 5/1987 Felder
D294,881 S 3/1988 Swanson
4,888,713 A * 12/1989 Falk ..... G06T 15/04
345/582
D306,511 S 3/1990 Jones
5,065,458 A 11/1991 Johnson
D339,220 S 9/1993 Buziol
D339,221 S 9/1993 Olajide
5,282,277 A 2/1994 Onozawa
5,535,451 A 7/1996 Tassone et al.
D378,237 S 3/1997 McDonald
5,990,444 A 11/1999 Costin
6,035,448 A 3/2000 Thomson
D428,548 S 7/2000 Hosogai
6,175,966 B1 1/2001 Wiesenthal
6,182,296 B1 2/2001 Hosogai
D439,727 S 4/2001 Hosogai
D453,606 S 2/2002 Foy-Watson
D454,245 S 3/2002 Logan
6,430,748 B1 8/2002 Burkhart
6,430,753 B2 8/2002 Duran
D466,676 S 12/2002 Lyden
D472,099 S 3/2003 Grove et al.
D473,694 S 4/2003 Lyden
D476,464 S 7/2003 Jenkins
D483,551 S 12/2003 Kallen
D483,924 S 12/2003 Morisset
D491,712 S 6/2004 Morisset
D511,606 S 11/2005 Caucci
D514,775 S 2/2006 Szabo
7,058,987 B2 6/2006 Salazar
7,081,036 B1 7/2006 Howard et al.
D527,866 S 9/2006 Fixel
D528,742 S 9/2006 Langmantel
7,107,621 B2 9/2006 Meekins
D532,958 S 12/2006 Kent
7,143,453 B2 12/2006 Duran
7,257,847 B2 8/2007 Hart
D558,954 S 1/2008 Lew
7,328,460 B1 2/2008 Mancini
D567,477 S 4/2008 Smith et al.
D568,582 S 5/2008 Peters
7,377,834 B2 5/2008 Fu
D571,537 S 6/2008 Wager
D577,878 S 10/2008 Perrine et al.
D583,529 S 12/2008 Gardner, III et al.
D584,487 S 1/2009 Maimon
D585,184 S 1/2009 Fleenor
D586,084 S 2/2009 Mendoza
D588,336 S 3/2009 Fazeli
7,500,274 B1 3/2009 Kallen
D592,829 S 5/2009 Kepekchyan
D596,830 S 7/2009 Zarur et al.
D597,282 S 8/2009 Smith et al.
D599,976 S 9/2009 Barden
D600,882 S 9/2009 Johnson, Jr.
D601,779 S 10/2009 Escoto
D608,079 S 1/2010 Boyle et al.
D610,329 S 2/2010 Prechel
D612,128 S 3/2010 Hall et al.
D616,630 S 6/2010 Christiansen
D618,438 S 6/2010 Hall et al.
D619,783 S 7/2010 Jones et al.
D620,228 S 7/2010 Jones et al.
D620,683 S 8/2010 Brindley
D620,687 S 8/2010 Lubell
7,814,576 B2 10/2010 Nakazawa
7,832,022 B1 11/2010 Peters
7,908,674 B2 3/2011 Jones
7,950,069 B2 5/2011 Lee
D648,922 S 11/2011 Evans et al.
D650,154 S 12/2011 Saavedra
D651,379 S 1/2012 Halpern
D661,465 S 6/2012 Smith et al.
D663,922 S 7/2012 Karik et al.
D663,923 S 7/2012 Karik et al.
D666,789 S 9/2012 Hines
D674,993 S 1/2013 Howie
D679,482 S 4/2013 Fuerst
D686,800 S 7/2013 Kelly
D690,084 S 9/2013 Grosbol
D696,488 S 12/2013 Kenney et al.
D696,840 S 1/2014 Brown
D698,520 S 2/2014 Anderson et al.
D703,416 S 4/2014 Roberts et al.
8,869,313 B2 10/2014 Maramotti
8,959,665 B1 2/2015 Garner et al.
8,984,668 B2 3/2015 Tulin et al.
D728,898 S 5/2015 Haeberle
D730,621 S 6/2015 Boyle
D730,625 S 6/2015 Boyle
D731,150 S 6/2015 Styles
D732,801 S 6/2015 Magevonna
9,044,051 B1 6/2015 Rydman et al.
D733,398 S 7/2015 Ellis et al.
D733,400 S 7/2015 Cunningham
D735,447 S 8/2015 Brown
D735,973 S 8/2015 Hodis
D736,495 S 8/2015 Bednarz
D739,995 S 10/2015 Howie
D741,571 S 10/2015 Tulin et al.
D741,574 S 10/2015 Michaeloff
D742,099 S 11/2015 Wager
D742,621 S 11/2015 Callahan
D745,251 S 12/2015 Bednarz
D746,543 S 1/2016 McClain

(56) References Cited

U.S. PATENT DOCUMENTS

| | | | |
|---|---|---|---|
| D750,347 | S | 3/2016 | Boyle et al. |
| 9,320,306 | B2 | 4/2016 | Freddi et al. |
| D756,600 | S | 5/2016 | Mamiye |
| 9,326,552 | B2 | 5/2016 | Hays et al. |
| D758,695 | S | 6/2016 | Lago |
| D758,696 | S | 6/2016 | Castellan |
| D762,072 | S | 7/2016 | Greenstein |
| D762,946 | S | 8/2016 | McArthur et al. |
| D764,755 | S | 8/2016 | Urban et al. |
| D766,546 | S | 9/2016 | Grosbol |
| D768,359 | S | 10/2016 | Lago |
| D769,579 | S | 10/2016 | Griffin |
| 9,468,239 | B2 | 10/2016 | Battah |
| D770,128 | S | 11/2016 | Howie |
| D770,133 | S | 11/2016 | Burke et al. |
| D770,728 | S | 11/2016 | Jaklinski |
| D774,731 | S | 12/2016 | Harris et al. |
| D777,404 | S | 1/2017 | Lomax |
| D779,160 | S | 2/2017 | Wu |
| D779,161 | S | 2/2017 | Darmour et al. |
| D779,787 | S | 2/2017 | Lomax |
| D780,404 | S | 3/2017 | Grosbol |
| D782,681 | S | 3/2017 | Cai et al. |
| D783,939 | S | 4/2017 | Scott |
| D787,159 | S | 5/2017 | Lago et al. |
| 9,648,910 | B2 | 5/2017 | Cronan |
| D788,408 | S | 6/2017 | Lago |
| D789,035 | S | 6/2017 | Terrell |
| D790,158 | S | 6/2017 | McArthur et al. |
| 9,668,525 | B2 | 6/2017 | Boyle et al. |
| D793,032 | S | 8/2017 | Carpenter et al. |
| D793,033 | S | 8/2017 | Neary et al. |
| D796,785 | S | 9/2017 | Suarez et al. |
| D801,001 | S | 10/2017 | Keys et al. |
| 9,775,386 | B2 | 10/2017 | Forsythe |
| 9,801,420 | B2 | 10/2017 | Hays et al. |
| D802,256 | S | 11/2017 | Peshek et al. |
| D803,523 | S | 11/2017 | Wang et al. |
| D804,782 | S | 12/2017 | Harris et al. |
| D809,248 | S | 2/2018 | Hart |
| D811,047 | S | 2/2018 | Posada |
| D811,049 | S | 2/2018 | Peshek et al. |
| D812,349 | S | 3/2018 | Peshek et al. |
| D816,944 | S | 5/2018 | Gonzalez |
| 9,955,741 | B2 | 5/2018 | Roup |
| 10,004,281 | B2 | 6/2018 | Rowe et al. |
| 10,034,504 | B2 | 7/2018 | Boyle |
| D835,384 | S | 12/2018 | Mark et al. |
| D838,085 | S | 1/2019 | Peshek et al. |
| D838,935 | S | 1/2019 | Mark et al. |
| D839,542 | S | 2/2019 | Strange |
| D840,638 | S | 2/2019 | Peshek et al. |
| D841,940 | S | 3/2019 | Peshek et al. |
| D844,296 | S | 4/2019 | Lin |
| 10,314,357 | B2 | 6/2019 | Hoffman et al. |
| 10,327,487 | B2 | 6/2019 | Peshek et al. |
| 2002/0116748 | A1 | 8/2002 | Lipsett et al. |
| 2004/0006811 | A1 | 1/2004 | McKenzie |
| 2004/0205879 | A1 | 10/2004 | Leba |
| 2005/0091728 | A1 | 5/2005 | Rocha |
| 2005/0166298 | A1 | 8/2005 | Pieroranzio |
| 2005/0177920 | A1 | 8/2005 | Wilkinson |
| 2005/0184997 | A1 | 8/2005 | Lake et al. |
| 2006/0189253 | A1 | 8/2006 | Jones |
| 2006/0218698 | A1 | 10/2006 | Toyne |
| 2006/0235656 | A1 | 10/2006 | Mochimaru et al. |
| 2007/0015439 | A1 | 1/2007 | Fu |
| 2007/0266478 | A1 | 11/2007 | Girod |
| 2008/0271226 | A1 | 11/2008 | Erana Ahumada |
| 2009/0031486 | A1 | 2/2009 | Sokolowski et al. |
| 2009/0144173 | A1 | 6/2009 | Mo et al. |
| 2009/0157021 | A1 | 6/2009 | Sullivan et al. |
| 2010/0064409 | A1 | 3/2010 | Buckley |
| 2010/0136882 | A1 | 6/2010 | Malish |
| 2010/0192283 | A1 | 8/2010 | Kim |
| 2010/0242156 | A1 | 9/2010 | Calautti |
| 2011/0010818 | A1 | 1/2011 | Hood |
| 2011/0185477 | A1 | 8/2011 | Olenicoff |
| 2011/0214216 | A1 | 9/2011 | Zarabi |
| 2012/0023644 | A1 | 2/2012 | Maramotti |
| 2013/0145516 | A1 | 6/2013 | Zielinski |
| 2013/0210318 | A1 | 8/2013 | Kakuno et al. |
| 2013/0219589 | A1 | 8/2013 | Jones |
| 2013/0276201 | A1 | 10/2013 | Pezzimenti |
| 2013/0312157 | A1 | 11/2013 | Freddi et al. |
| 2014/0035913 | A1 | 2/2014 | Higgins et al. |
| 2014/0047618 | A1 | 2/2014 | Robins et al. |
| 2014/0059741 | A1 | 3/2014 | Lou et al. |
| 2014/0096309 | A1 | 4/2014 | Hughes |
| 2014/0114620 | A1 | 4/2014 | Grinspun et al. |
| 2014/0150166 | A1 | 6/2014 | Hall et al. |
| 2014/0165265 | A1 | 6/2014 | Tulin et al. |
| 2014/0182044 | A1 | 7/2014 | Cole |
| 2014/0250575 | A1 | 9/2014 | Man |
| 2014/0273742 | A1 | 9/2014 | Hays et al. |
| 2014/0310854 | A1 | 10/2014 | Kianmahd |
| 2014/0325732 | A1 | 11/2014 | Anderson |
| 2015/0082516 | A1 | 3/2015 | Doan |
| 2015/0106993 | A1 | 4/2015 | Hoffman et al. |
| 2015/0196068 | A1 | 7/2015 | Tulin et al. |
| 2015/0201679 | A1 | 7/2015 | Wong |
| 2015/0213646 | A1 | 7/2015 | Ma et al. |
| 2015/0339853 | A1 | 11/2015 | Wolper et al. |
| 2016/0021942 | A1 | 1/2016 | Vauge-Lalanne et al. |
| 2016/0050986 | A1 | 2/2016 | Leandry Melendez et al. |
| 2016/0113334 | A1 | 4/2016 | Roup |
| 2016/0150832 | A1 | 6/2016 | Solano et al. |
| 2016/0189431 | A1 | 6/2016 | Ueda et al. |
| 2016/0227854 | A1 | 8/2016 | Ellis |
| 2016/0324234 | A1 | 11/2016 | Hoffman et al. |
| 2016/0353806 | A1 | 12/2016 | Mendon a coutsoumbos |
| 2016/0366963 | A1 | 12/2016 | Koshkaroff et al. |
| 2018/0014583 | A1 | 1/2018 | Peshek et al. |
| 2018/0014590 | A1 | 1/2018 | Peshek et al. |
| 2018/0020752 | A1 | 1/2018 | Peshek et al. |
| 2018/0110273 | A1 | 4/2018 | Peshek et al. |
| 2018/0168256 | A1 | 6/2018 | Peshek et al. |

FOREIGN PATENT DOCUMENTS

| | | | | |
|---|---|---|---|---|
| CN | 301600315 | S | 7/2011 | |
| CN | 301869010 | S | 3/2012 | |
| CN | 302245662 | S | 12/2012 | |
| CN | 302245667 | S | 12/2012 | |
| CN | 302554428 | S | 9/2013 | |
| CN | 105286115 | A | 2/2016 | |
| EP | 2740373 | | 11/2014 | |
| EP | 3060075 | A4 | 6/2017 | |
| FR | 2876880 | B3 | 9/2006 | |
| FR | 2876680 | B3 * | 1/2007 | ..... A01K 97/06 |
| JP | 1996209670 | A | 8/1996 | |
| JP | 1998102386 | A | 4/1998 | |
| JP | 1999053427 | A | 2/1999 | |
| JP | 2000235589 | A | 8/2000 | |
| JP | 2004156153 | A | 6/2004 | |
| JP | 2004348172 | | 12/2004 | |
| JP | 2005256232 | A | 9/2005 | |
| JP | 2005264718 | A | 9/2005 | |
| JP | 2006118095 | A | 5/2006 | |
| JP | D1293314 | | 1/2007 | |
| JP | 2008038321 | A | 2/2008 | |
| JP | 2008274452 | A | 11/2008 | |
| JP | 2010255247 | A | 11/2010 | |
| JP | 2013213303 | A | 10/2013 | |
| JP | D1560443 | | 9/2016 | |
| JP | D1560445 | | 9/2016 | |
| KR | 3020030009422 | | 4/2003 | |
| KR | 1020120001856 | A | 1/2012 | |
| KR | 300642737 | | 4/2012 | |
| KR | 300884486 | | 12/2016 | |
| WO | 2006032096 | A1 | 3/2006 | |
| WO | 2007055072 | A1 | 5/2007 | |
| WO | 2007112494 | A1 | 10/2007 | |
| WO | 2012004365 | A1 | 1/2012 | |

(56) References Cited

FOREIGN PATENT DOCUMENTS

| | | | |
|---|---|---|---|
| WO | 2013010004 | A2 | 1/2013 |
| WO | 2013154445 | A1 | 10/2013 |
| WO | 2015066149 | A1 | 5/2015 |
| WO | 2018017732 | A1 | 1/2018 |

OTHER PUBLICATIONS

Translation FR 2876880B3 Description English (Year: 2006).*
Hoffman, "Visual Intelligence: How We Create What We See", Published by W.W. Norton, 2000.
Cuenca-Guerra, et al., "What makes Buttocks Beautiful" A Review and Classification of the Determinants of Gluteal Beauty and the Surgical Techniques to Achieve Them, Aesthetic Plastic Surgery, 2004 Springer Science +Business Media, Inc. 2004.
Men's Jeans and women's jeans and denim jacket measurements to check or make your own pattern, Oct. 11, 2007, https://web.archive.org/web/20071011004827/http://www.jeansinfo.org/measurements.html.
Sweetheart Yoke, posted by Indigo Slims, available from Internet, URL: http://indigoslims.blogspot.com/2009_02_01_archive.html, Feb. 16, 2009, 1 page.
Anonymous, "Kilowog muscle suit", Aug. 3, 2010, XP055371226, http://theleagueofheroes.yuku.com. Retreived from the Internet: http://theleagueofheroes.yuku.com/topic9266/Kilowog-muscle-suit#.WRL4-HpMek5, 7 pages.
Pocket Picker, bluemooney.wordpress.com, https://bluemooney.wordpress.com/2011/06/13/pocket-picker/, Jun. 13, 2011, 2 pages.
Presto Pockets, Macaroni & Cheese Blog, http://mac-aroni-ncheese.blogspot.com/2011/04/tutorial-presto-pockets.html, Apr. 5, 2011, 1 page.
Xtreme Gray Butt Lift Jeans 32 and 38 Inseam, hotsexyfit.com, http://www.hotsexyfit.com/XTREME-GRAY-BUTT-LIFT-JEANS.html, May 16, 2011, 2 pages.
How to Find the Perfect Skinny Jeans, denimblog.com, http://www.denimblog.com/2012/08/how-to-find-the-perfect-skinny-jeans/, Aug. 29, 2012, 2 pgs.
Nike X Undercover Gyakusou Spring 2012 collection, https://news.nike.com/news/nike-x-undercover-present-gyakusou-international-running-association-spring-2012, found Mar. 6, 2018, 1 page.
Truly WOW Slim Leg Jeans Long Simply Be, Aug. 1, 2012, 3 pages, http://www.simplybe.co/uk/shop/truly-wow-slimleg-jeans-long.co.uk/shop/truly-wow-slim-leg-jeans-long/qy094/product/details/show.action?pdBoUiD=5205#colour;size.
2013 Jean Contest Entry posted by Aunty Maimu, posted date Jul. 2013, Blogspot.com, [online], [site visited May 9, 2017]. Available from Internet, <http://lockstitchandtwosmokingneedles.blogspot.com/2013/07/patternreviewcom-2013-jean-contest-entry.html>.
White Pants, published unknown by JSnell333, Poshmark, available from Internet, https://poshmark.com/listing/White-pants-with-black-stripe-down-the-side-5700760fc284569c830140be, Apr. 13, 2017, 7 pages.
Columbia, Womens—Pilsner Peak Pull on Cargo Capri, https://www.columbia.com/womens-pilsner-peak-pull-on-cargo-capri-1773681.html?cgid=new-arrivals&dwvar_1773681_variationColor=591, known at least as early as Nov. 26, 2018, 2 pgs.
Another Edition, Denim Pants, Zozo Resort, http://zozo.jp/shop/anotheredition/goods.html?gid=211522&did=&cid=976, Dec. 1, 2007, 2 pgs.
Curvy Girls, posted by My Rolling Rack, available from Internet, URL:https://myrollingrack.wordpress.com/2014/01/, Jan. 31, 2014, 2 pages.
DIY, Side Panel Sweatpants, Dec. 25, 2014, YouTube [online], https://www.youtube.com/watch?v=o9LKUhjVLrM&t=255s, 4 pages.
Gap Polka Dot Shirt Dress, "Runway, Your Way: How to Wear Polka Dots for Spring" by Lesley Kennedy, Mile High Style, denverpost.com, https://www.youtube.com/watch?v=o9LKUhjVLrM&t=255s, May 7, 2013, 3 pgs.
Lee 101 Jeans posted by Gerald Garcia, GeekLounge.com available from Internet, https://geeklounge.wordpress.com/2014/06/, Jun. 2014, 35 pages.
PCT International Search Report in PCT/US2014/061277, dated Jan. 27, 2015, 5 pages.
TKMaxx, Black Geometric Shift Dress, http://www.tkmaxx.com/view-all-womenswear/black-geometric-shift-dress/invt/30025743, Jun. 30, 2015, 1 pg.
Ande Whall Jeans posted by Bugula, selvedgestyle.com, available from Internet, http://selvedgestyle.com/thread/973/ande-whall, Sep. 6, 2015, 3 pages.
Casual Colarinho De Camisa, posted to lightinthebox.com. Posted date Nov. 20, 2015, Available on internet: <https://www.lightinthebox.com/pt/vestidos-ganga-mulheres-casual-colarinho-de camisa-manga-comprida_p4468050.html>.
Spoon Graphics "8 Free Stipple Shading Brushes for Adobe Illustrator", May 25, 2015 , https://blog.spoongraphics.co.uk/freebies/8-free-stipple-shading-brushes-for-adobe-illustrator.
Ways to Wear Side Stripe Pants, by Sita Gabriel, YouTube, available from Internet, https://www.youtube.com/watch?v=nTcsJOz-qwc,Jun. 3, 2015, 2 pages.
European Extended Search Report in Application 14854060.2, dated May 18, 2017, 9 pages.
Japanese Office Action in Application 2017-000740, dated May 30, 2017, 2 pages.
Japanese Office Action in Application 2017-000744, dated May 30, 2017, 2 pages.
PCT International Search Report in PCT/US2017/042200, dated Nov. 28, 2017, 22 pages.
PCT International Search Report in PCT/US2017/042885, dated Sep. 11, 2017, 14 pages.
PCT International Search Report in PCT/US2017/042888, dated Sep. 11, 2017, 6 pages.
PCT International Search Report in PCT/US2018/017967, dated Apr. 26, 2018, 6 pages.
U.S. Appl. No. 29/553,279, 312 Amendment filed Apr. 12, 2017, 10 pages.
Chinese Office Action for CN App. # 201780053346.X, dated May 6, 2020, 11 pgs.
Chinese Office Action for CN App. #201780057163.X, dated Apr. 3, 2020, 26 pgs.
Blue Gold American Jeans (slides from video clip found at https://www.imdb.com/title/tt1597028/), 2014, 10 pgs.
Trendy Stretch Jeans, Ebay, Jul. 11, 2018, 3 pgs.
Rotita Pocket Denim Dress, www.rotita.com, Jun. 7, 2020, 3 pgs.
Lee Softhand Denim, https://blog.naver.com/usedcompany/60203120183, Nov. 7, 2013, 8 pgs.
Chinese Office Action for CN201780057163.5, dated Nov. 23, 2020, 11 pgs.
Japanese Office Action for JP2019502742, dated Jun. 2, 2020, 11 pgs.
Japanese Office Action for JP2019502719, dated May 12, 2020, 7 pgs.
Chinese Office Action for CN201780057374.9, dated Nov. 3, 2020, 15 pgs.
Chinese Office Action for CN201780057374.9, dated Mar. 30, 2020, 10 pgs.
European Examination Report for EP17745615.9, dated Apr. 1, 2020, 4 pgs.
European Search Report for EP20180532.2, dated Sep. 23, 2020, 8 pgs.
Korean Office Action for KR1020197004395, dated May 9, 2020, 14 pgs.
Korean Office Action for KR1020197004271, dated May 9, 2020, 21 pages.

* cited by examiner

ANATOMY SHADING FOR GARMENTS

CROSS-REFERENCE TO RELATED APPLICATIONS

This application is a divisional application of U.S. Non-provisional application Ser. No. 14/517,339 filed Oct. 17, 2014; which claims the benefit of U.S. Provisional Application No. 61/892,749, filed Oct. 18, 2013, each of which are hereby incorporated by reference in their entirety.

BACKGROUND

It is common for clothing manufacturers to form patterns on jeans that simulate wear or that make another fashion statement. Such patterns are often referred to as "finishes" and are typically formed by manually abrading the jean material or using specialized lasers that remove dye from the outer surface of the material. These finishes form brightness gradients on the jeans. Specifically, areas that have been acted upon will be lighter than areas that have not been acted upon.

The human vision system automatically interprets brightness gradients, such as those formed on jeans, as three-dimensional forms. When the gradients are associated with the human form, human beings automatically assign an attractiveness to the three-dimensional forms. Therefore, when a pair of jeans having a particular finish is worn by an individual, others automatically make determinations as to the attractiveness of the individual's lower body based in part on the nature of the finish.

A problem with existing finishes is that they can actually make the individual's form less attractive to others, a result that is clearly not desired by the individual wearing the garment. It would therefore be desirable to form patterns on jeans, or other garments, that do not reduce the attractiveness of the wearer. Indeed, it would be desirable to form patterns on garments that make the wearer more physically attractive.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
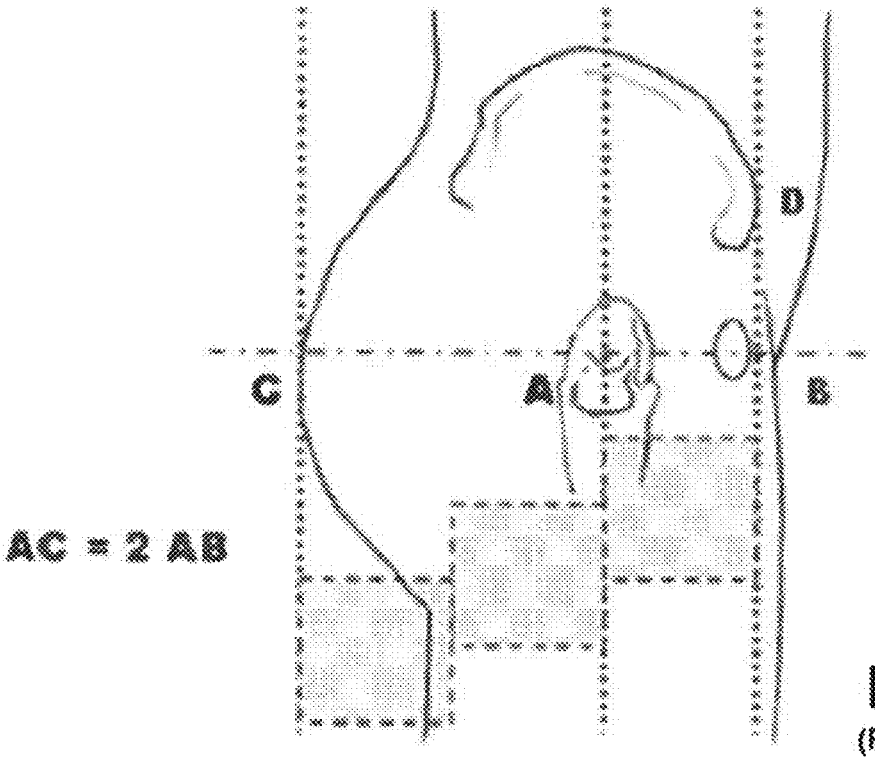
FIG. 1 (PRIOR ART)
FIG. 1 is a schematic diagram of ideal female buttocks and thighs in side view.

As described above, it would be desirable to form patterns on garments that do not reduce the attractiveness of the wearer and, more preferably, increase the physical attractiveness of the wearer. Disclosed herein are systems and methods for achieving these goals, as well as garments that result from use of the systems and methods. Generally speaking, the garments include a pattern that forms a brightness gradient across the surface of the garment that emulates the contours of an ideally proportioned body. Because the brightness gradient is based upon ideal proportions of the human form and because the brain interprets the gradients as three-dimensional shapes, the gradients create a three-dimensional interpretation of a maximally attractive form, thereby increasing the attractiveness of the garment wearer. In some embodiments, the brightness gradients are generated by creating ideally attractive three-dimensional models of the human form for each of multiple garment sizes and illuminating the models to generate brightness gradients that can be used to create two-dimensional templates, which can be used to form the patterns on the garments. Because the patterns are based on the anatomy of an ideally proportioned body, the patterns can be referred to as "anatomy shading."

In the following disclosure, various specific embodiments are described. It is to be understood that those embodiments are example implementations of the disclosed inventions and that alternative embodiments are possible. All such embodiments are intended to fall within the scope of this disclosure.

It is known from the field of vision science that brightness gradients are automatically interpreted by the human visual system in terms of three-dimensional shapes. Therefore, brightness gradient patterns on garments, such as jean finishes, trigger the visual system to automatically engage in creating a three-dimensional shape. The human vision further automatically evaluates human shapes for attractiveness. It is known from the field of evolutionary psychology that each time an individual encounters a person, the individual's brain automatically evaluates a multitude of sensory cues relating to the health and reproductive fitness of the person within a fraction of a second. The individual's initial judgment on attractiveness is a summary of that evaluation, with greater attractiveness being felt toward individuals who appear healthier and more reproductively fit. Therefore, the three-dimensional shape of a person's body is a critical sensory cue that is used to assess the attractiveness of the person.

In view of these insights, it has been determined that clothing patterns can be utilized to capitalize upon the natural operation of the human vision system and brain. In particular, brightness gradient patterns can be provided on garments that trick the visual system into visualizing attractive three-dimensional shapes. Described below are garment patterns that can be used to increase the perceived attractiveness of the garment wearer. More particularly, described below are jeans "finishes" for the posterior of women's jeans that increase the attractiveness of the wearer's buttocks and upper thighs. While this specific application is discussed in detail, it is noted that the same principles can be applied to create patterns for substantially any body part and substantially any garment.

The literature in the plastic surgery field has identified several properties of the three-dimensional shape of the female buttocks and upper thighs that are considered to be highly attractive. FIG. 1 is a schematic diagram of a female buttock and thigh in side view that identifies various distances that can be used to gauge attractiveness. In this figure, point A identifies the location of the greater trochanter, point B identifies the point of maximal projection of the mons veneris, point C identifies the point of maximal gluteal projection, and point D identifies the location of the anterior superior iliac spine.

Figure 2:
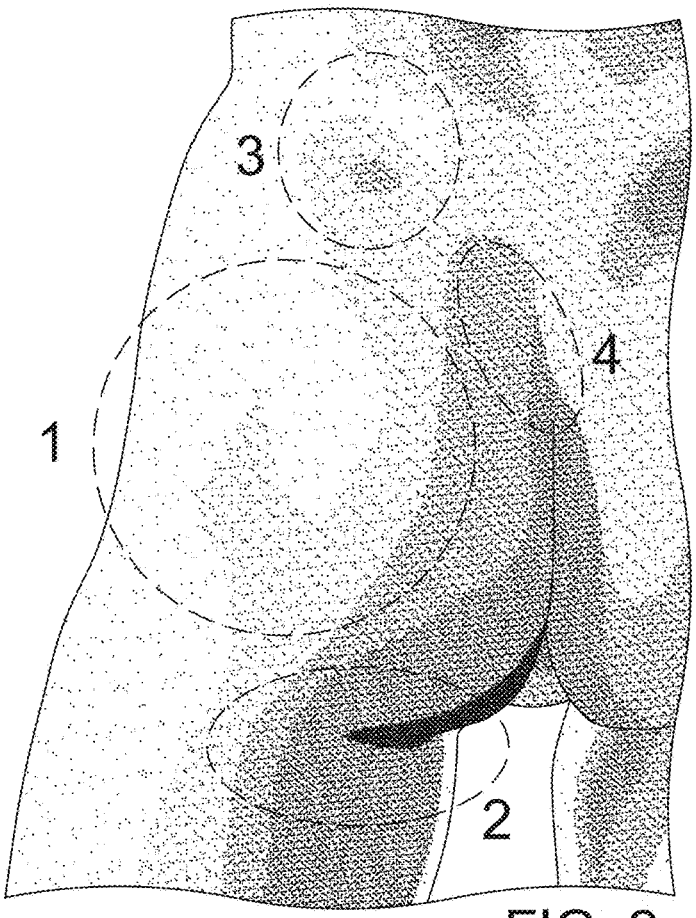
FIG. 2 (PRIOR ART)
FIG. 2 is a photograph of ideal features for female buttocks and thighs in rear view.

FIG. 2 is a photograph of ideally proportioned female buttocks and thighs in rear view and identifies various areas that have an impact upon attractiveness. Area 1 is the lateral depression formed by the lateral border of the gluteus maximus, the quadratus femoris, and the insertions of the gluteus medius and vastus lateralis to the greater trochanter (hereinafter the "lateral gluteal depression"). Area 2 is the infragluteal fold created by the ischial tuberosity, the insertions of the semitendinous muscle and long belly of the biceps femoris, and the lower border of the gluteus maximus (hereinafter the "infragluteal fold"). Area 3 is the supragluteal fossette positioned over the posterior superior iliac spine and created by the multifidus muscle, the lumbodorsal aponeurosis, and the insertion of the gluteus maximus (hereinafter the "supragluteal fossette"). Area 4 is the V-shaped crease arising in the proximal portion of the gluteal crease (hereinafter the "V-shaped crease"). According to Cuenca-Guerra & Quezada in "What Makes Buttocks Beautiful? A Review and Classification of the Determinants of Gluteal Beauty and the Surgical Techniques to Achieve Them" (Aesthetic Plastic Surgery, 2004 September-October; 28(5): 340-7. 2004), which is hereby incorporated by reference into the present disclosure, ideally attractive buttocks/thighs are those that satisfy the following criteria:

1. The distance between points A and C (FIG. 1) should be twice as large as the distance between points A and B;
2. The infragluteal fold (Area 2; FIG. 2) should not extend beyond two-thirds the width of the thigh;
3. The lower spine (FIG. 1) should be angled out five to seven degrees from vertical; and
4. The V-shaped crease (Area 4; FIG. 2) should be about the size shown in the photograph.

If a template can be created that gives the observer the impression of the shapes that result from some or all of these criteria, the attractiveness of a wearer of a pair of jeans having a finish based upon the template can be increased.

Figure 3:
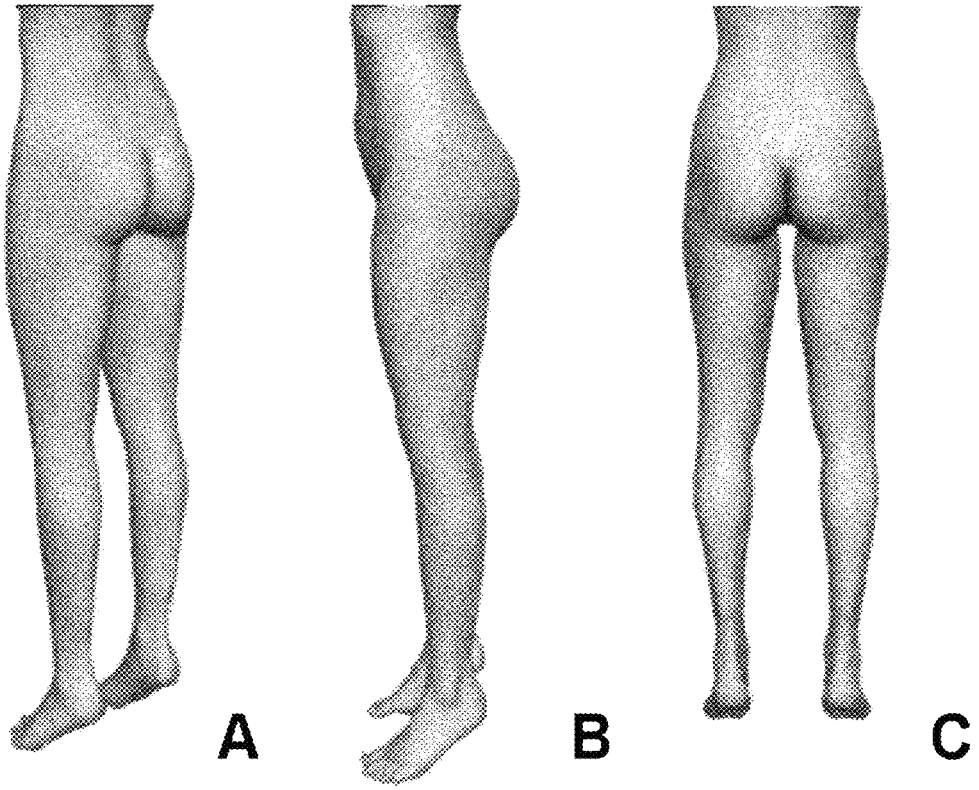
FIG. 3 shows renderings of three-quarter, side, and rear views of an ideal size 2 avatar.
Figure 4:
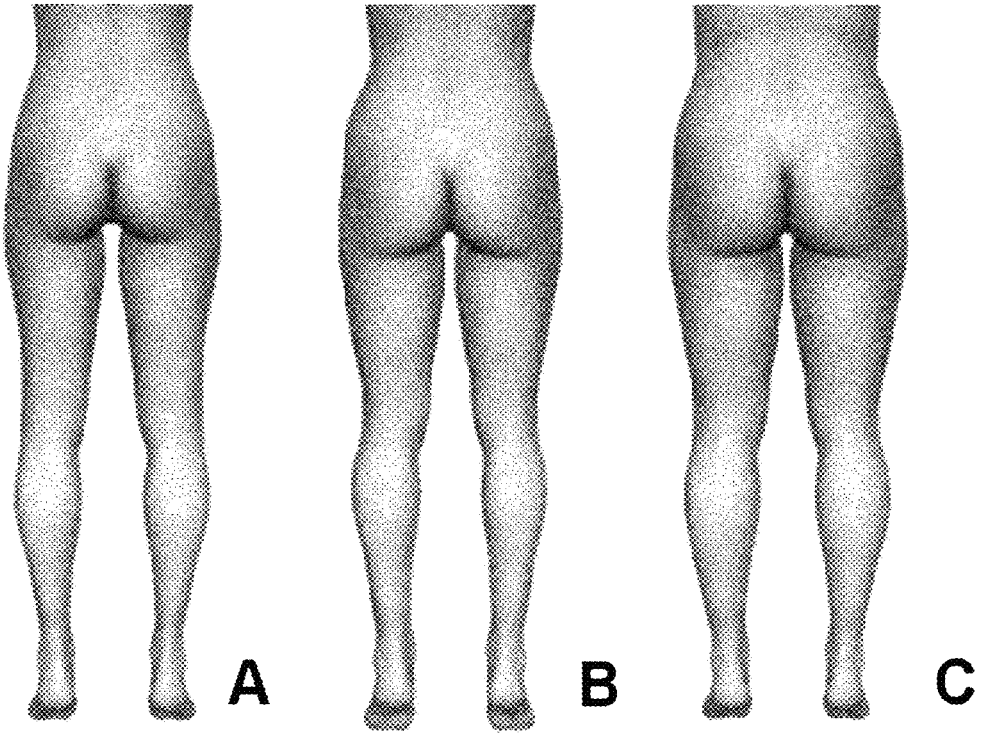
FIG. 4 shows renderings of rear views of ideal size 6, 10, and 14 avatars.

Templates of the type described above can be created in a variety of ways. In some embodiments, templates can be created based upon three-dimensional computer models, or avatars, of ideal human forms. More particularly, an ideal avatar can be created for each of multiple body (e.g., pant) sizes for the purpose of creating a template for each size. FIG. 3 shows an example size 2 avatar in three-quarters, side, and rear view that was created with a software program called V-Stitcher™. The avatar shown in this figure was created so as to satisfy each of Criteria 1-4 identified above. Therefore, the avatar can be considered to be an ideal size 2 avatar in terms of physical attractiveness. FIG. 4 shows further avatars for sizes 6, 10, and 14 (from left to right) in rear view. Again, each avatar satisfies Criteria 1-4 and, therefore, each is an ideal avatar for its particular size.

As indicated in FIGS. 3 and 4, each avatar has been virtually illuminated so as to cast shadows on the avatars that reveal the contours of the avatars' shapes. In some embodiments, the illumination is an ideal illumination that both emulates natural lighting and best reveals the avatar's contours. This lighting therefore creates a three-dimensional brightness gradient across the surface of each avatar that accentuates the contours of the avatar.

Figure 5:
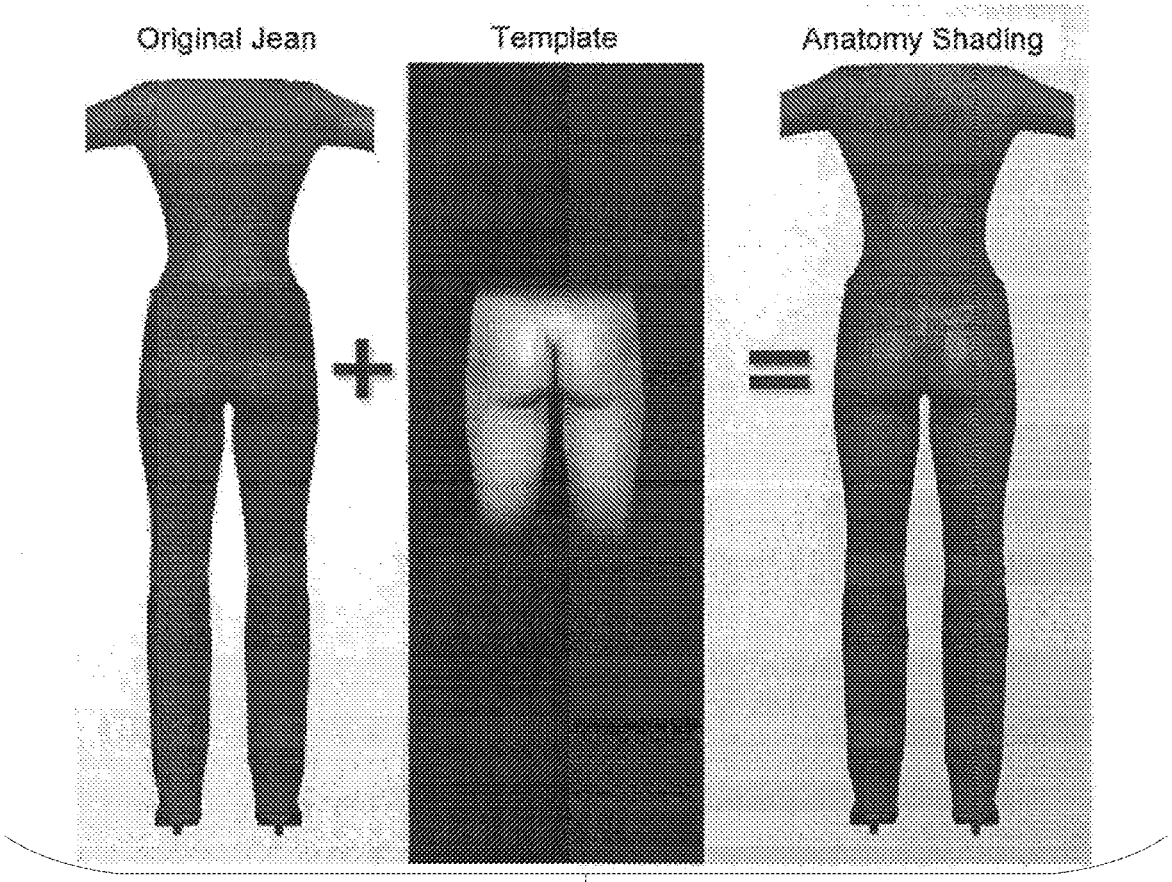
FIG. 5 is schematic illustration of the process of applying a pattern to jeans using a template created from an ideal avatar.

Once these brightness gradients have been generated, they can be used to create templates for patterns that can be applied to garments. This process is schematically illustrated in FIG. 5. The image in the left panel of FIG. 5 shows a simulation of a size 10 pair of jeans prior to applying a pattern. The jeans therefore have a uniform blue color and show minimal brightness gradients on the body. The image in the right panel of the figure shows a simulation of the jeans after the application of a pattern that was based upon a two-dimensional template, which is shown in the center panel. In this example, the template was created by capturing a two-dimensional snapshot of the three-dimensional ideal size 6 avatar from the rear perspective (see left image in FIG. 4). The pattern can be formed on the jeans in a variety of ways. In some embodiments, the pattern can be formed by manually or automatically abrading the garment (denim) substrate to create relatively light areas. In other embodiments, the relatively light areas can be formed by using a laser process.

As can be appreciated from the image in the right panel of FIG. 5, the jeans have been lightened in areas that are brightest in the template to emulate the three-dimensional shape of an ideal body. Accordingly, the jeans have "anatomy shading" that simulates the lighting that falls on an ideally proportioned three-dimensional body. The pattern/shading forms a brightness gradient that tricks the visual system into seeing the ideal three-dimensional shape. Because the brightness gradient emulates from the ideal avatar, which is based upon the ideal body shape, the gradient reflects at least some of the criteria for ideal buttocks and thighs described above. Generally speaking, the brightness gradient pattern has relatively bright spots associated with high points of the contours of ideally proportioned buttocks and relatively dark spots associated with low points of the contours of the ideally proportioned buttocks. As can be appreciated from a comparison between FIGS. 2 and 5, the brightness gradient is relatively bright in the areas associated with the central region of each buttock.

In addition, the gradient is relatively dark in the areas associated with the infragluteal folds of the ideally proportioned body (Area 2) and the medial V-shaped crease (Area 4) of the ideally portioned body, which directly correspond with Criteria 2 and 4 identified above. Notably, this is in direct contrast with conventional jeans finishes, which often are lightened in the areas of the infragluteal fold and/or the medial V-shaped crease.

Figure 6:
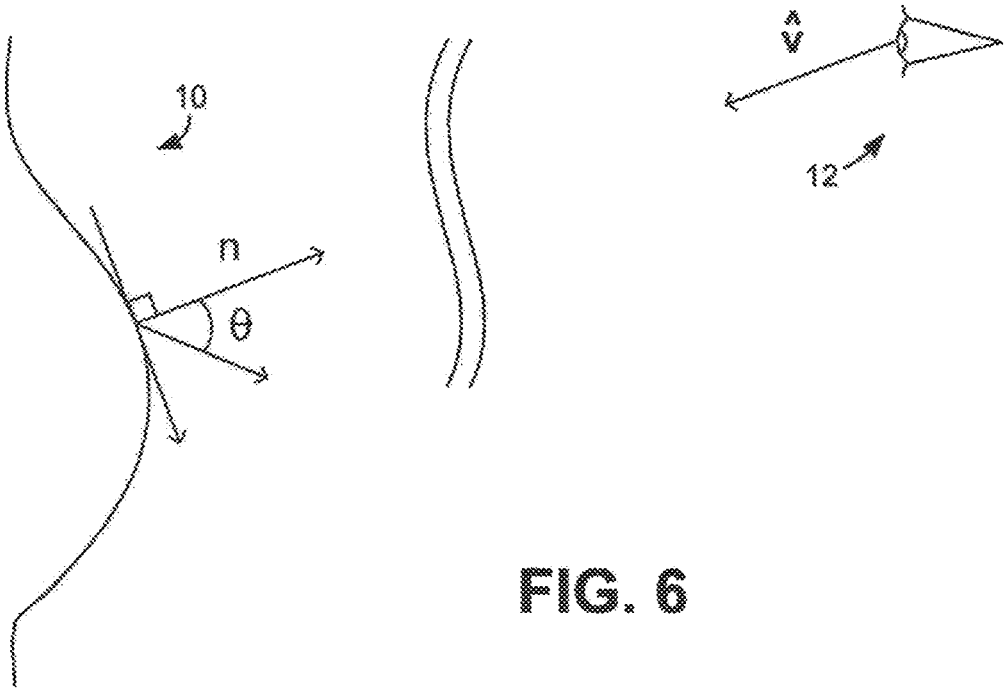
FIG. 6 is a schematic drawing illustrating how the brightness of the pattern varies relative to the perspective of an orthographic viewer.

The brightness gradient can further be described in terms of the perspective of the observer. This is illustrated in FIG. 6, which schematically shows a buttock 10 of a jeans wearer and the eye 12 of an orthographic observer. In this figure, the surface normal, n, points toward the observer, who observes the buttock 10 along the direction of a unit vector $\hat{v}$. The brightness of the gradient on the jeans is maximal at the normal point and decreases as the angle $\theta$ away from the normal increases. More particularly, the brightness of the gradient is a function of the cosine of $\theta$, which is greatest (i.e., 1) in the normal direction (i.e., $\theta=0°$) and smallest (i.e., 0) in the perpendicular direction (i.e., $\theta=90°$). Stated otherwise, the brightness of the pattern is proportional to $n\ \hat{v}$.

Although only the rear view of the avatar was used to form the pattern shown in FIG. 5, it is noted that alternative views (e.g., three-quarter view or side view) of the avatar can be used to create a template and pattern. In such cases, other criteria of ideally attractive buttocks/thighs may be taken into greater account. Moreover, it is noted that two or more avatar views can be combined to form a hybrid brightness gradient template and pattern.

Figure 7:
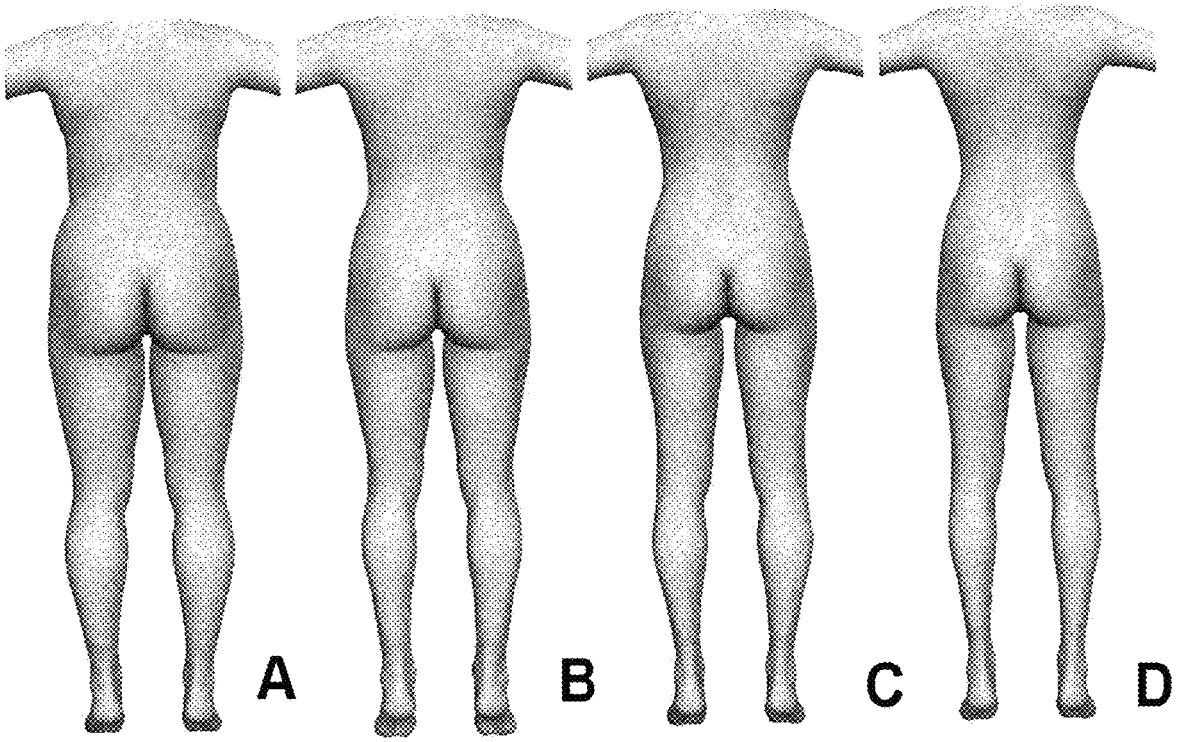
FIG. 7 is a graphical representation of sets of control points C(x, y, z) for the rear view of ideal size 14, 10, 6, and 2 avatars.

The brightness gradients can be further mathematically defined using a set of control points C(x, y, z) in $R^3$ given by a discrete function of the form C(x, y, z)=(x, y, b(x, y)). FIG. 7 provides graphical representations of four sets of control points that are the basis for brightness gradients for the rear view of apparent in sizes 14, 10, 6, and 2 (from left to right). The control points are not shown numerically, but instead are represented by individual pixels in the graphical representations. In these graphical representations, the function b(x, y) is rendered as the brightness of pixels in three-dimensional space. Numerical values of the control points are available, but for each graphical representation, these numerical values comprise an array of, for example, 860×2,423=2,083,780 numbers. As will be recognized, the figure represents a large array of control points which can be readily determined by using known techniques to digitize the graphical representation.

Given the control points C(x, y, z)=(x, y, b(x, y)), a corresponding brightness gradient is any subset of any discretization of any continuous function A((x, y, a(x, y)) satisfying $\nabla a=\nabla\lambda S(b(x,y))$ where S is a surface spline of order 3 or greater, $\lambda\epsilon R^+$ is a global scale factor, and $$\nabla = \left(\frac{\partial}{\partial x'}\frac{\partial}{\partial y}\right)$$

is the gradient. These mathematics indicate that one can obtain a brightness gradient from a set of control points C(x, y, z) by using a polynomial function, such as a spline curve. For example, the brightness gradient can be obtained by: (1) creating a surface spline from the control points, (2) scaling the surface spline, (3) computing the slope at each control point, (4) interpolating a surface that matches the slope at each control point, (5) discretizing this surface, (6) adding to each point Gaussian noise of zero mean and standard deviation less than 10% of the standard deviation of the entire surface, and (7) selecting the subset of the discretized surface that corresponds appropriate to the location on the garment. Step (6) allows for small variations in anatomy finishes due to effects such as laser noise and the micro-structure of the fabric of the garment.

Figure 8:
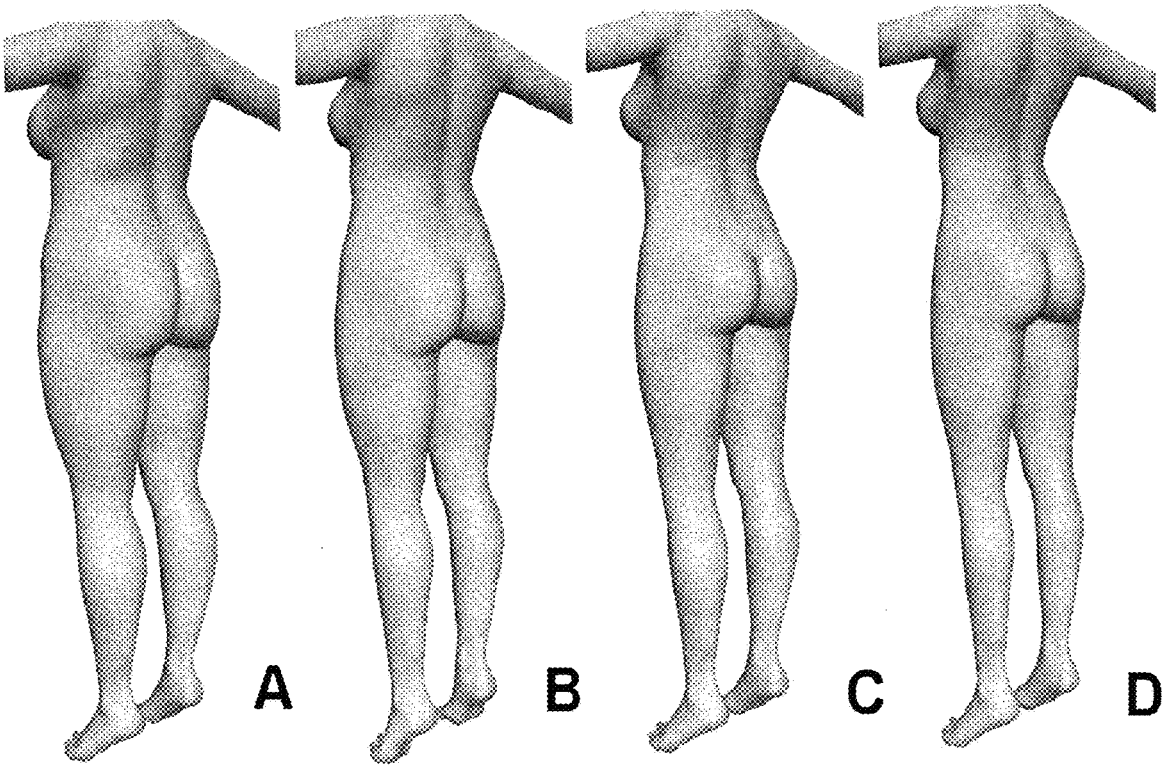
FIG. 8 is a graphical representation of sets of control points C(x, y, z) for the three-quarter view of ideal size 14, 10, 6, and 2 avatars.
Figure 9:
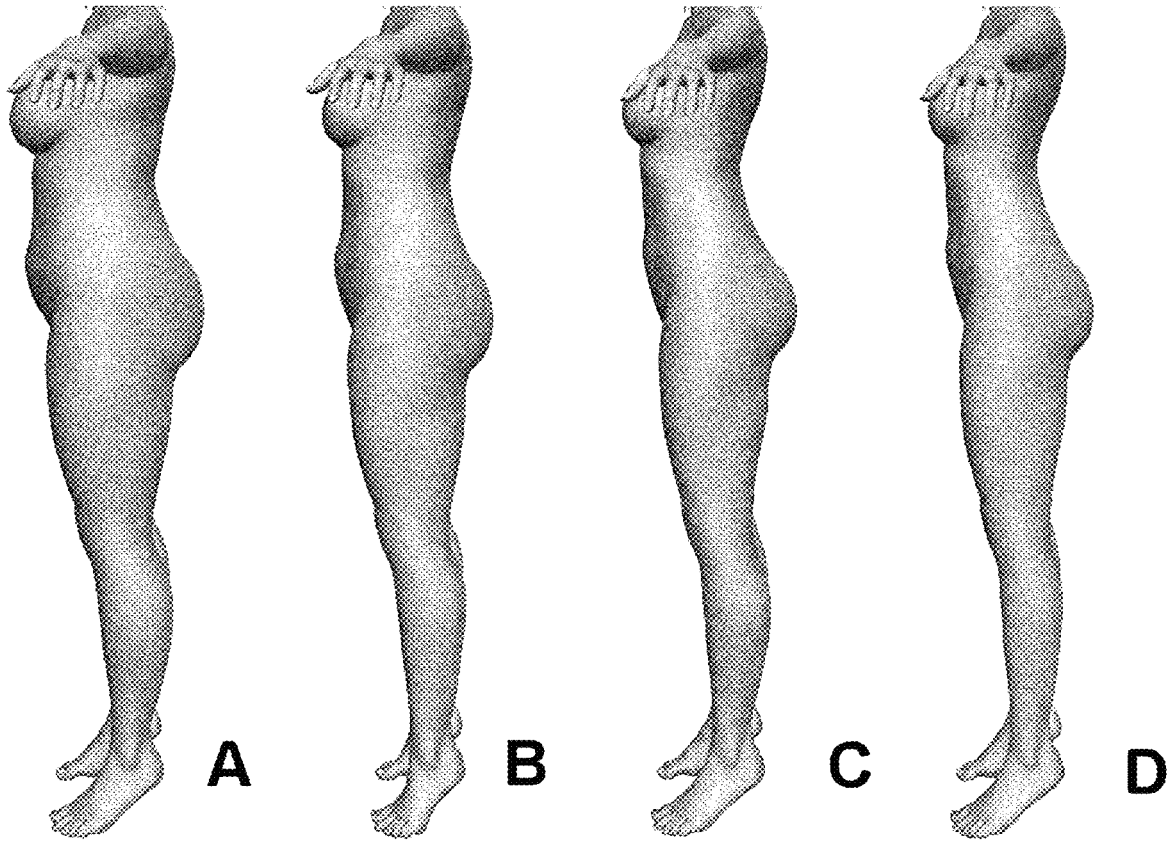
FIG. 9 is a graphical representation of sets of control points C(x, y, z) for the side view of size ideal 14, 10, 6, and 2 avatars.

FIG. 8 provides a graphical representation of sets of control points that can be used as the basis for providing a brightness gradient to the three-quarter view of apparel for sizes 14, 10, 6, and 2 (from left to right). FIG. 9 provides a graphical representation of sets of control points that can be used as the basis for a brightness gradient to the side view of apparel for sizes 14, 10, 6, and 2 (from left to right). All control points in these examples are available as arrays of 860×2,423 numbers, which were used to generate the graphical representations.

Figure 10:
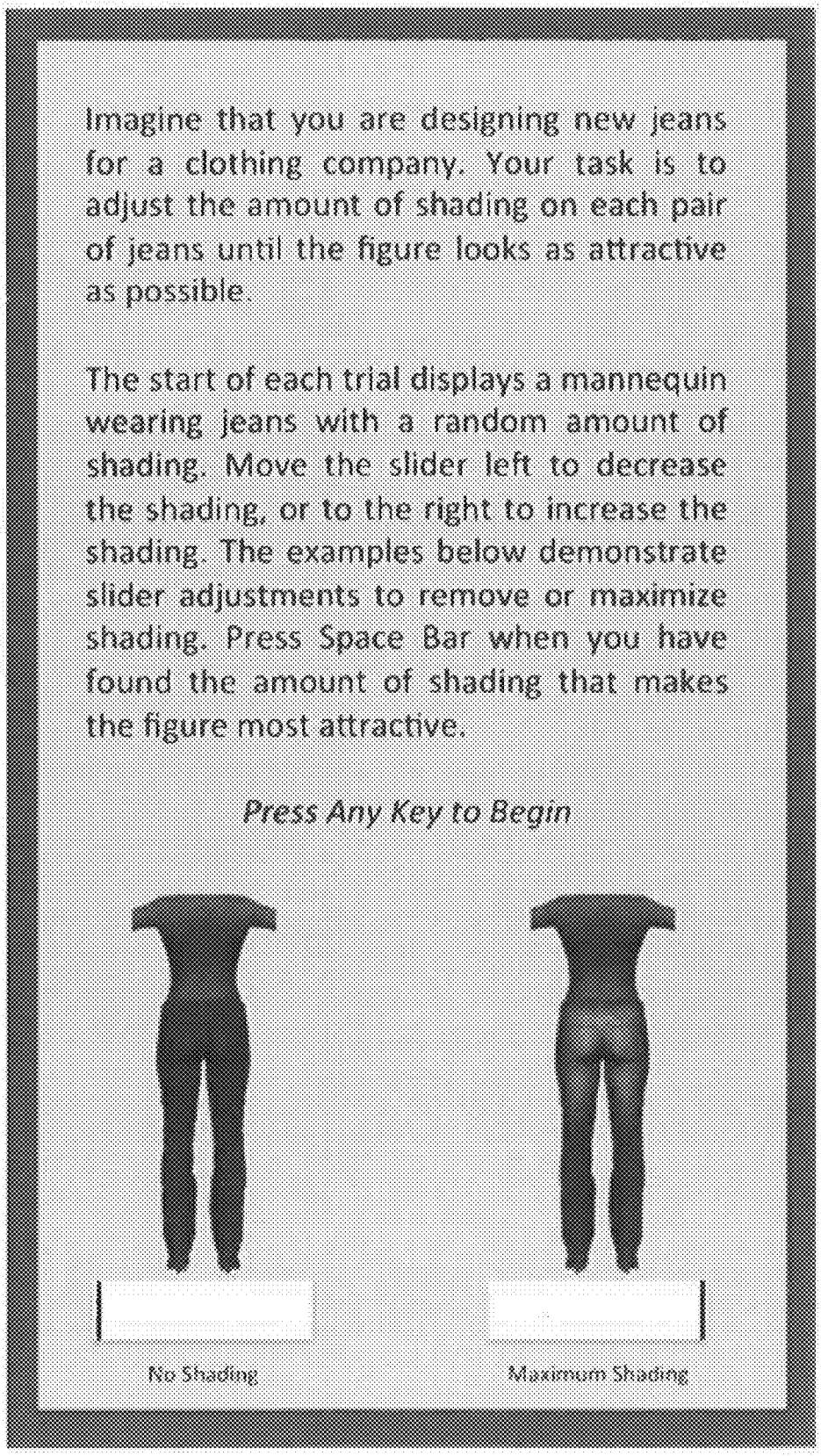
FIG. 10 shows instructions that were provided to subjects in an experiment to evaluate anatomy patterns formed on jeans.

Once a brightness gradient has been created, one still must determine the magnitude that the gradient will have when it is applied to a garment as anatomy shading and, therefore, how obvious the gradient will be. A psychophysical experiment was designed to determine the optimal magnitude of the brightness gradient when provided on jeans. In the experiment, participants were given the freedom to adjust how bright the gradient appeared, from invisible to highly visible. The participants could not, however, modify the brightness gradient (i.e., relative brightness), which was fixed. Participants were instructed to adjust the amount of "shading" until the human figure looked maximally attractive. FIG. 10 shows the full instructions displayed before the experiment. Participants made adjustments on jeans observed from the rear view, the three-quarters view, and the side view.

Figure 11:
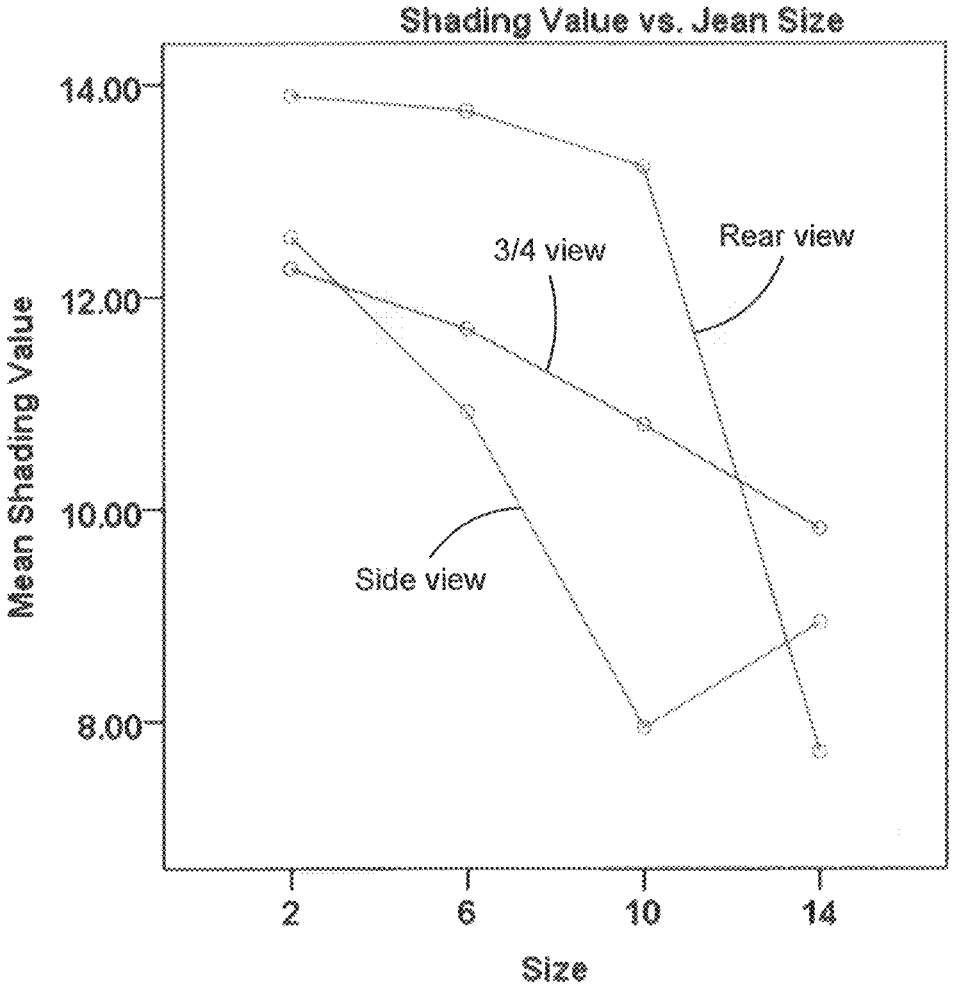
FIG. 11 is a graph of the results of the experiment described in FIG. 10.
Figure 12:
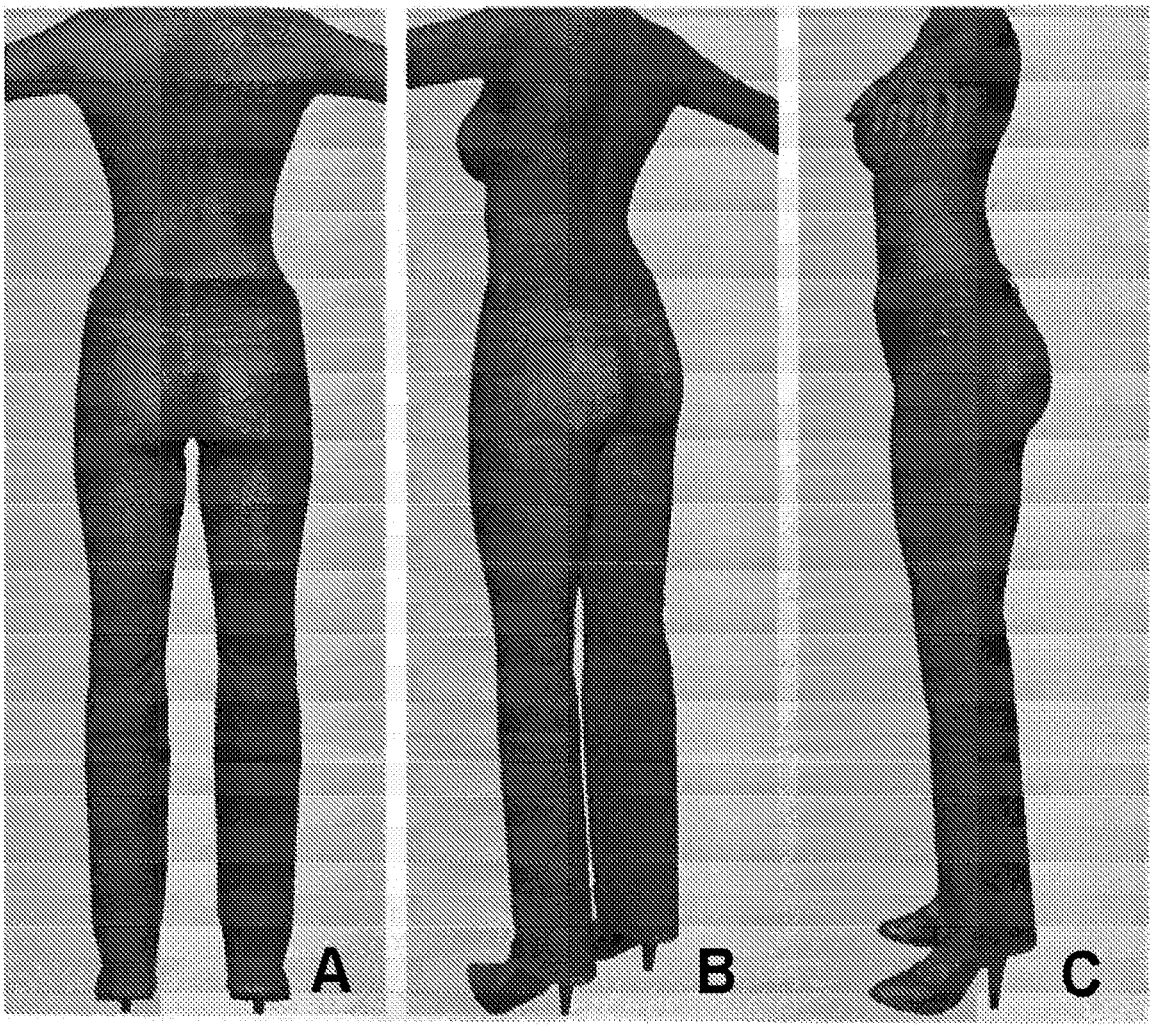
FIG. 12 is a rendering of an optimal anatomy-shading finish for size 2 jeans.
Figure 13:
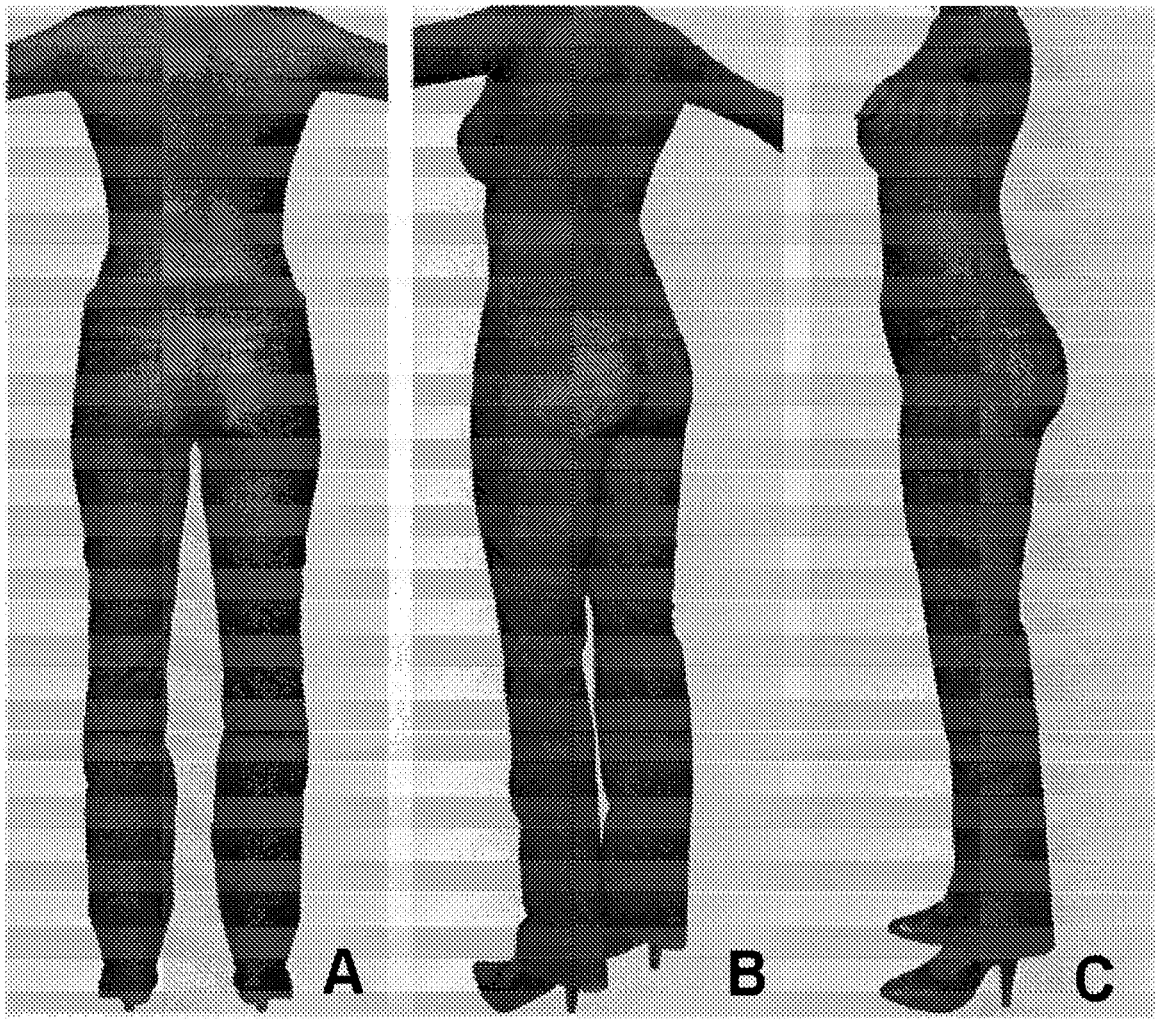
FIG. 13 is a rendering of an optimal anatomy-shading finish for size 6 jeans.
Figure 14:
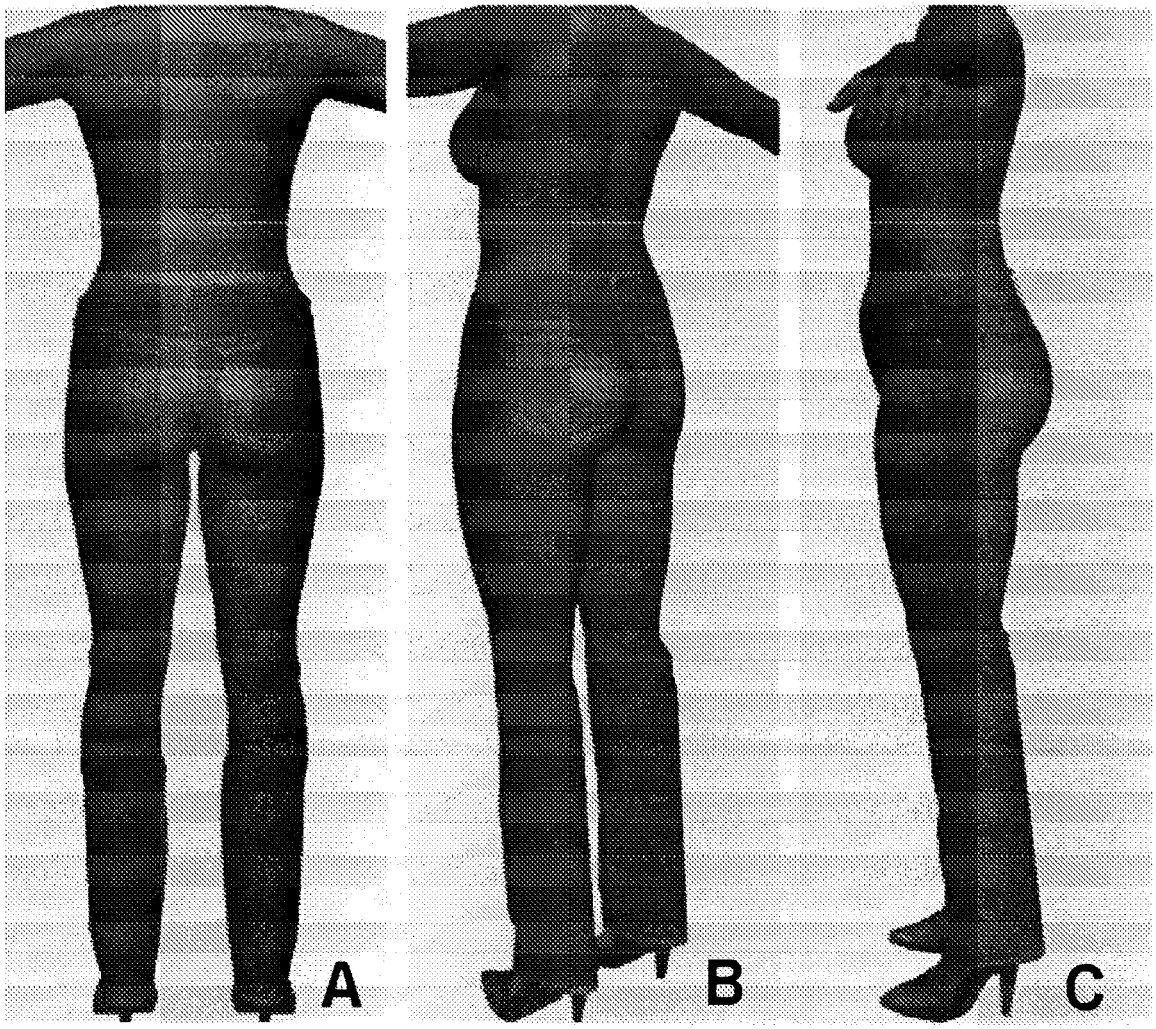
FIG. 14 is a rendering of an optimal anatomy-shading finish for size 10 jeans.
Figure 15:
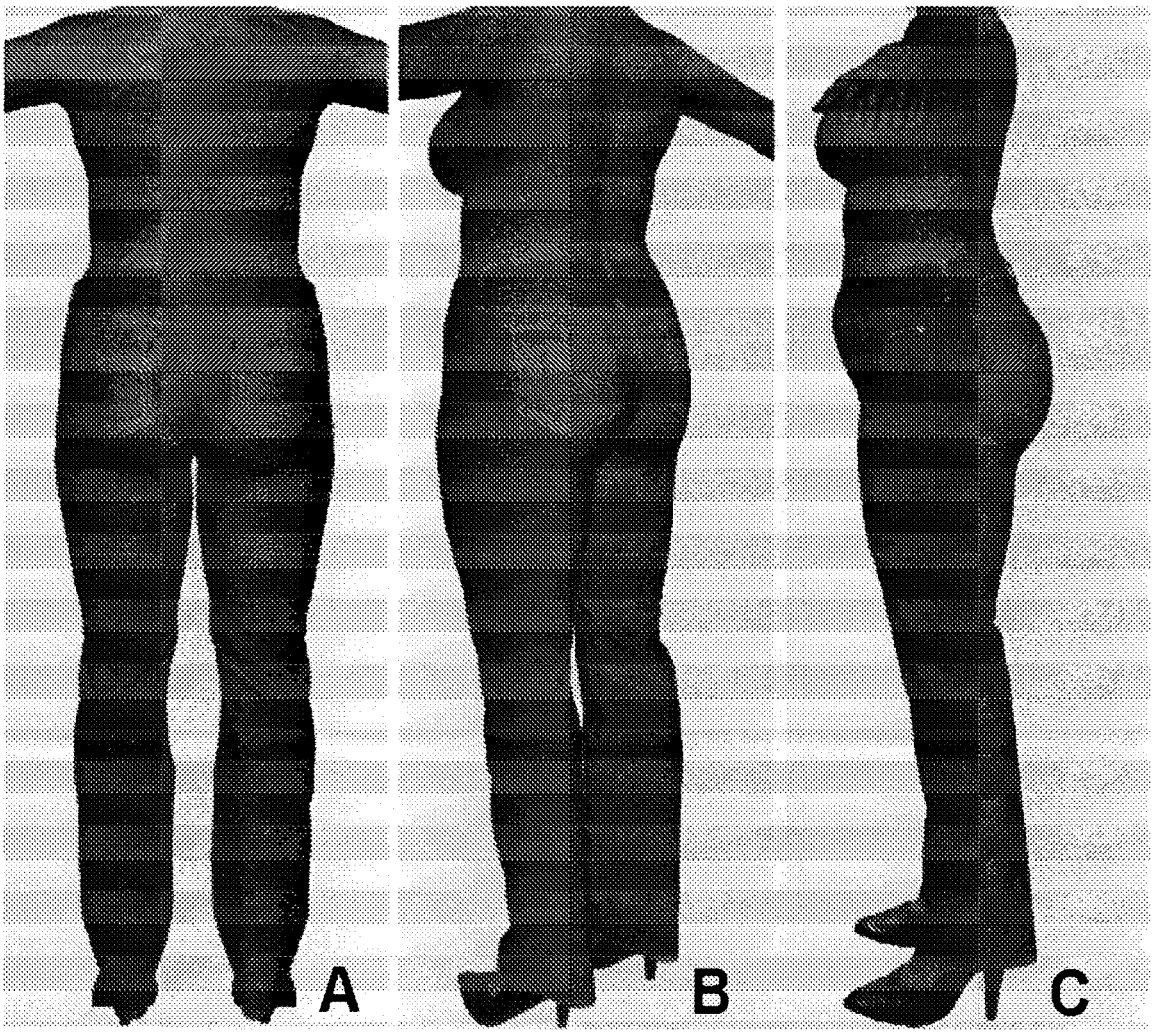
FIG. 15 is a rendering of an optimal anatomy-shading finish for size 14 jeans.

The results of this experiment are shown in the graph of FIG. 11. This graph identifies the optimal visibility for the brightness gradient for size 2, 6, 10, and 14, jeans and for each direction of view (rear, three-quarters, side). The x axis of the graph corresponds to the jean size while the y axis corresponds to the mean shading value, which is a measure of the overall contrast in the anatomy shading region, which extended from the waist to the knees. The mean shading value therefore provides an indication of how noticeable the anatomy shading is. A value of "0" corresponds to no contrast (i.e., the region is completely dark) while a value of "100" corresponds to maximal contrast with the background jean (i.e., the region is completely white). As can be appreciated from FIG. 11, the optimal magnitude of the brightness gradient varies between sizes and views. One general trend, however, is that smaller sizes benefit from more visible brightness gradients while larger sizes benefit from less visible brightness gradients. For example, the ideal mean shading value for a size 2 pair of jeans is about 14, while the ideal mean shading value for a size 14 pair of jeans is about 8. The optimal anatomy shading that was determined through the experimentation for sizes 2, 6, 10, and 14 is illustrated in FIGS. 12-15, respectively. As can be appreciated from these figures, the anatomy shading provided on each pair of jeans is similar to that shown in the image of the right panel of FIG. 5, irrespective of the magnitude. Therefore, in each case, the high points of the buttocks are relatively light while infragluteal fold and V-shaped crease areas are relatively dark.

As an alternative and non-limiting embodiment, anatomy shaded pants according to the present invention (including but not limited to jeans) may comprise, either singly or in any combination, (a) relatively bright spots associated with the central region of each buttock, (b) relatively dark spots associated with the infragluteal folds, and (c) relatively bright spots associated with the upper rear thighs of the ideally proportioned body. It will be appreciated that the location and size of the relatively bright and dark spots will vary depending on the size of the pant or jean.

In some embodiments, the relatively bright spots associated with the central region of each buttock may have center points that are generally vertically located between 4.5 and 7.5 inches above the crotch level, and generally horizontally located between 1.5 and 4.5 inches from the center seam; alternatively vertically located between 5 and 7 inches above the crotch level, and horizontally located between 2 and 4 inches from the center seam; alternatively vertically located between 5.5 and 7 inches above the crotch level, and horizontally located between 2.2 and 3.5 inches from the center seam; alternatively vertically located between 5.7 and 6.7 inches above the crotch level, and horizontally located between 2.5 and 3 inches from the center seam. For example, for size 6 jeans, the relatively bright spots associated with the central region of each buttock may have center points that are generally vertically located between 4.5 and 7.5 inches above the crotch level, and generally horizontally located between 1.5 and 4.5 inches from the center seam; alternatively vertically located between 5 and 7 inches above the crotch level, and horizontally located between 2 and 4 inches from the center seam; alternatively vertically located between 5.5 and 6.5 inches above the crotch level, and horizontally located between 2.3 and 3.2 inches from the center seam; alternatively vertically located between 5.7 and 6.1 inches above the crotch level, and horizontally located between 2.5 and 3 inches from the center seam. And for example, for size 14 jeans, the relatively bright spots associated with the central region of each buttock may have center points that are generally vertically located between 5.5 and 7.5 inches above the crotch level, and generally horizontally located between 1.5 and 4.5 inches from the center seam; alternatively vertically located between 6 and 7 inches above the crotch level, and horizontally located between 2 and 4 inches from the center seam; alternatively vertically located between 6.2 and 6.8 inches above the crotch level, and horizontally located between 2.2 and 3.5 inches from the center seam; alternatively vertically located between 6.5 and 6.8 inches above the crotch level, and horizontally located between 2.7 and 2.9 inches from the center seam. Generally, the brightness gradient decreases outwardly from the center point (or region surrounding the center point) until the brightness level matches that of the garment before the finish was applied. The shape of each bright spot may vary but may be spherical, oval or aspherical. The bright spots will have a variable area depending on the gradient level. Alternatively, each bright spot may have an area of between 20 and 40 square inches, alternatively between 25 and 35 square inches.

In some embodiments, the relatively dark spots associated with the infragluteal folds may have center points that are generally vertically located between 0.5 inches below and 4 inches above the crotch level, and generally horizontally located between 3 and 6.5 inches from the center seam; alternatively vertically located between 0 and 3 inches above the crotch level, and horizontally located between 3.5 and 6 inches from the center seam; alternatively vertically located between 1 and 2.5 inches above the crotch level, and horizontally located between 4 and 5.5 inches from the center seam; alternatively vertically located between 1.3 and 2.3 inches above the crotch level, and horizontally located between 4 and 5 inches from the center seam. For example, for size 6 jeans, the relatively dark spots associated with the infragluteal folds may have center points that are generally vertically located between 0.5 inches below and 2.5 inches above the crotch level, and generally horizontally located between 3.5 and 6.5 inches from the center seam; alternatively vertically located between 0 and 2 inches above the crotch level, and horizontally located between 4 and 6 inches from the center seam; alternatively vertically located between 0.5 and 1.5 inches above the crotch level, and horizontally located between 4.5 and 5.5 inches from the center seam; alternatively vertically located between 1 and 1.3 inches above the crotch level, and horizontally located between 4.7 and 5.5 inches from the center seam. And for example, for size 14 jeans, the relatively dark spots associated with the infragluteal folds may have center points that are generally vertically located between 1.5 and 4 inches above the crotch level, and generally horizontally located between 3 and 6 inches from the center seam; alternatively vertically located between 2 and 3.5 inches above the crotch level, and horizontally located between 3.5 and 5.5 inches from the center seam; alternatively vertically located between 2 and 3 inches above the crotch level, and horizontally located between 4 and 5 inches from the center seam; alternatively vertically located between 2.3 and 2.7 inches above the crotch level, and horizontally located between 4.2 and 4.7 inches from the center seam. Generally, the brightness gradient increases outwardly from the center point (or region surrounding or contiguous with the center point) until the brightness level matches that of the garment before the finish was applied. The shape of each dark spot may vary but may generally be an irregular elongated oval or curving projection that extends outwards from the crotch. The dark spots will have a variable area depending on the gradient level. Alternatively, each dark spot may have an area of between 4 and 20 square inches, alternatively between 5 and 15 square inches, alternatively between 6 and 12 square inches.

In some embodiments, the relatively bright spots associated with the upper rear thighs may have center points that are generally vertically located between 1.5 and 4.5 inches below the crotch level, and generally horizontally located between 5 and 8 inches from the inner seam of the leg; alternatively vertically located between 2 and 4 inches below the crotch level, and horizontally located between 5.5 and 7.5 inches from the inner seam of the leg; alternatively vertically located between 2 and 3 inches below the crotch level, and horizontally located between 6 and 7 inches from the inner seam of the leg; alternatively vertically located between 2.5 and 3 inches below the crotch level, and horizontally located between 6 and 6.8 inches from the inner seam of the leg. For example, for size 6 jeans, the relatively bright spots associated with the upper rear thighs may have center points that are generally vertically located between 1.5 and 3.5 inches below the crotch level, and generally horizontally located between 5 and 7.5 inches from the inner seam of the leg; alternatively vertically located between 2 and 3 inches below the crotch level, and horizontally located between 5.5 and 7 inches from the inner seam of the leg; alternatively vertically located between 2.2 and 2.8 inches below the crotch level, and horizontally located between 5.8 and 6.7 inches from the inner seam of the leg; alternatively vertically located between 2.3 and 2.7 inches below the crotch level, and horizontally located between 6 and 6.5 inches from the inner seam of the leg. And for example, for size 14 jeans, the relatively bright spots associated with the upper rear thighs may have center points that are generally vertically located between 1.5 and 4.5 inches below the crotch level, and generally horizontally located between 5 and 8 inches from the inner seam of the leg; alternatively vertically located between 2 and 4 inches below the crotch level, and horizontally located between 5.5 and 7.3 inches from the inner seam of the leg; alternatively vertically located between 2.5 and 3.5 inches below the crotch level, and horizontally located between 6 and 7 inches from the inner seam of the leg; alternatively vertically located between 2.8 and 3.2 inches below the crotch level, and horizontally located between 6.3 and 6.9 inches from the inner seam of the leg. Generally, the brightness gradient decreases outwardly from the center point (or region surrounding the center point) until the brightness level matches that of the garment before the finish was applied. The shape of each bright spot may vary but may generally be an elongated regular or irregular (or partial regular or irregular) oval. The bright spots will have a variable area depending on the gradient level. Alternatively, each bright spot may have an area of between 20 and 80 square inches, alternatively between 20 and 50 square inches, alternatively between 25 and 40 square inches.

The magnitude of the brightness of the bright spots and the degree of contrast between the bright spots and the dark spots may vary. The magnitude of the brightness of bright spots on jeans and other garments can be measured through use of a spectroradiometer. By way of non-limiting example, the peak magnitude of the brightness of the bright spots on the garments described herein, as measured by spectroradiometer under normal indoor fluorescent lighting, may range anywhere from 2.5 to 6 cd/m$^2$, alternatively 2.8 to 5 cd/m$^2$, alternatively 3 to 4 cd/m$^2$.

Figure 17:
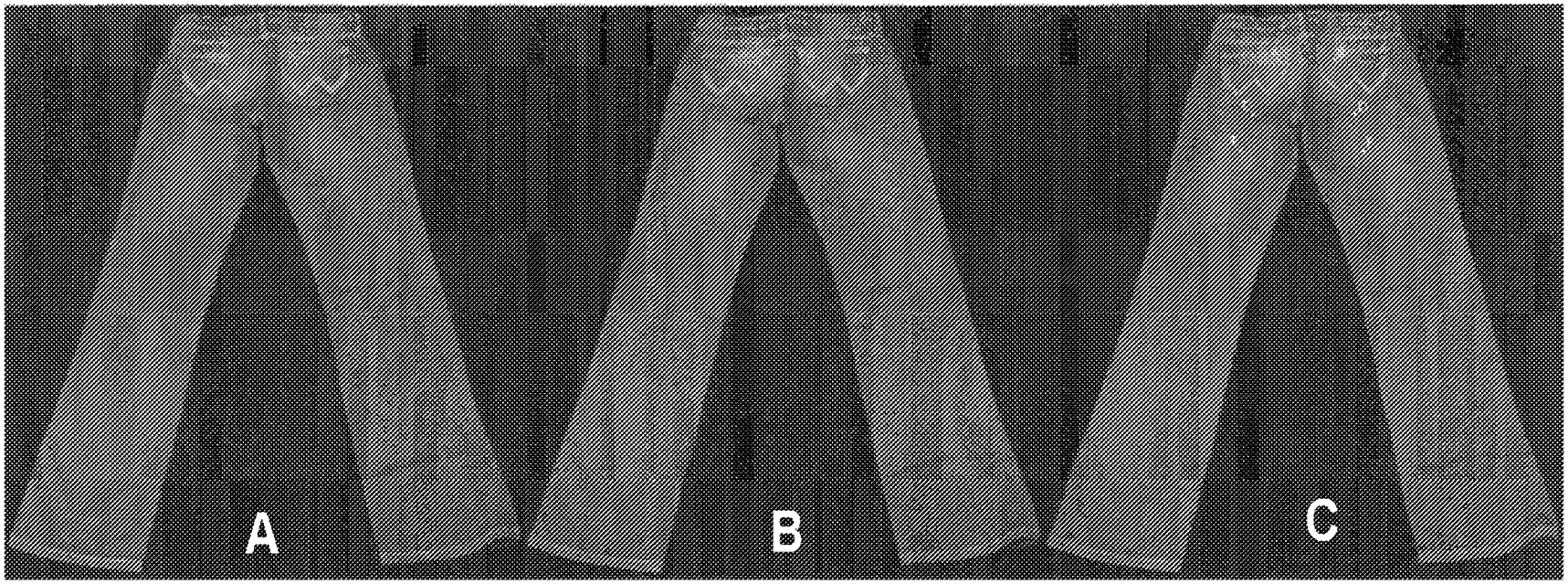
FIG. 17 is a digital photograph of the back side of a pair of size 6 women's jeans that have been anatomy shaded using a laser process. The same jeans are depicted three times: first in color, second in grayscale, and third in grayscale with reference letters.

FIG. 17 is a digital photograph of the back side of a pair of size 6 women's jeans that have been anatomy shaded using a laser process in accordance with the present invention. The digital image was analyzed to determine the location of the relatively bright spots associated with the central region of each buttock (points A and B in FIG. 17), the location of the relatively dark spots associated with the infragluteal folds (points C and D in FIG. 17), and the location of the relatively bright spots associated with the upper rear thighs (points E and F in FIG. 17). Table 1 lists values that were obtained from digital analysis of the photograph, as well as spectroradiometer readings that were taken on the jeans themselves. The first row lists the (x,y) coordinates of each point on the image. The second row list the digital brightness value for each point, where a value of zero is black and a value of 1 is maximum brightness. The third row lists the approximate horizontal distance of each point from the left edge of the center seam (from the inseam for the upper rear thighs) in inches. The fourth row lists the approximate vertical distance of each point from the crotch level (the top of the inseam of the jeans) in inches. The fifth row lists the luminance of each point in cd/m.sup.2, as measured under normal indoor fluorescent lighting with a SpectraScan® PR670 by Photo Research.

TABLE 1

| | A | B | C | D | E | F |
|---|---|---|---|---|---|---|
| (X, Y) Coordinate | (1667, 390) | (2062, 395) | (1484, 772) | 2204, 767) | (1397, 1028) | 2271, 1034) |
| Brightness Value (0-1) | 0.4549 | 0.4549 | 0.2902 | 0.27059 | 0.42745 | 0.43137 |
| Approximate distance from center seam (in.) | 2.5 | 3 | 5 | 5 | 6 | 6.5 |
| Approximate distance from crotch level (in.) | 6 | 5.75 | 1 | 1.25 | −2.5 | −2.5 |
| Luminance (cd/m2) | 3.583 | 3.384 | 2.067 | 2.163 | 3.083 | 2.652 |

Figure 18:
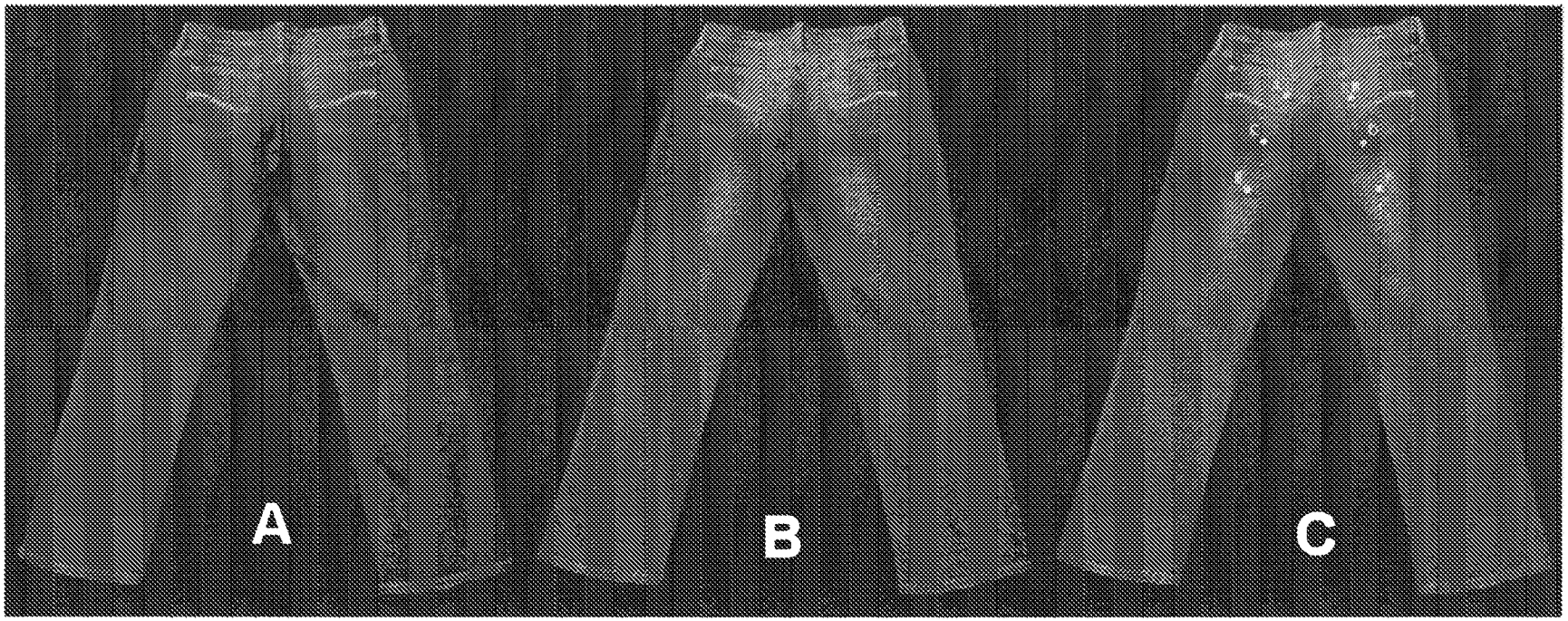
FIG. 18 is a digital photograph of the back side of a pair of size 14 women's jeans that have been anatomy shaded using a laser process. The same jeans are depicted three times: first in color, second in grayscale, and third in grayscale with reference letters.

FIG. 18 is a digital photograph of the back side of a pair of size 14 women's jeans that have been anatomy shaded using a laser process in accordance with the present invention. The digital image was analyzed to determine the location of the relatively bright spots associated with the central region of each buttock (points A and B in FIG. 18), the location of the relatively dark spots associated with the infragluteal folds (points C and D in FIG. 18), and the location of the relatively bright spots associated with the upper rear thighs (points E and F in FIG. 18). Table 2 lists values that were obtained from digital analysis of the photograph, as well as spectroradiometer readings that were taken on the jeans themselves. The rows in the table contain the same information as described for Table 1.

TABLE 2

| | A | B | C | D | E | F |
|---|---|---|---|---|---|---|
| (X, Y) Coordinate | (1729, 637) | (2180, 667) | (1568, 962) | (2278, 975) | (1454, 1301) | (2386, 1299) |
| Brightness Value (0-1) | 0.61569 | 0.53333 | 0.23922 | 0.2549 | 0.47843 | 0.43922 |
| Approximate distance from center seam (in.) | 2.5 | 2.75 | 4.25 | 4.5 | 6.75 | 6.5 |
| Approximate distance from crotch level (in.) | 6.5 | 6.75 | 2.5 | 2.5 | −3 | −3 |
| Luminance (cd/m2) | 3.907 | 4.065 | 2.237 | 2.053 | 3.912 | 4.039 |

Figure 16:
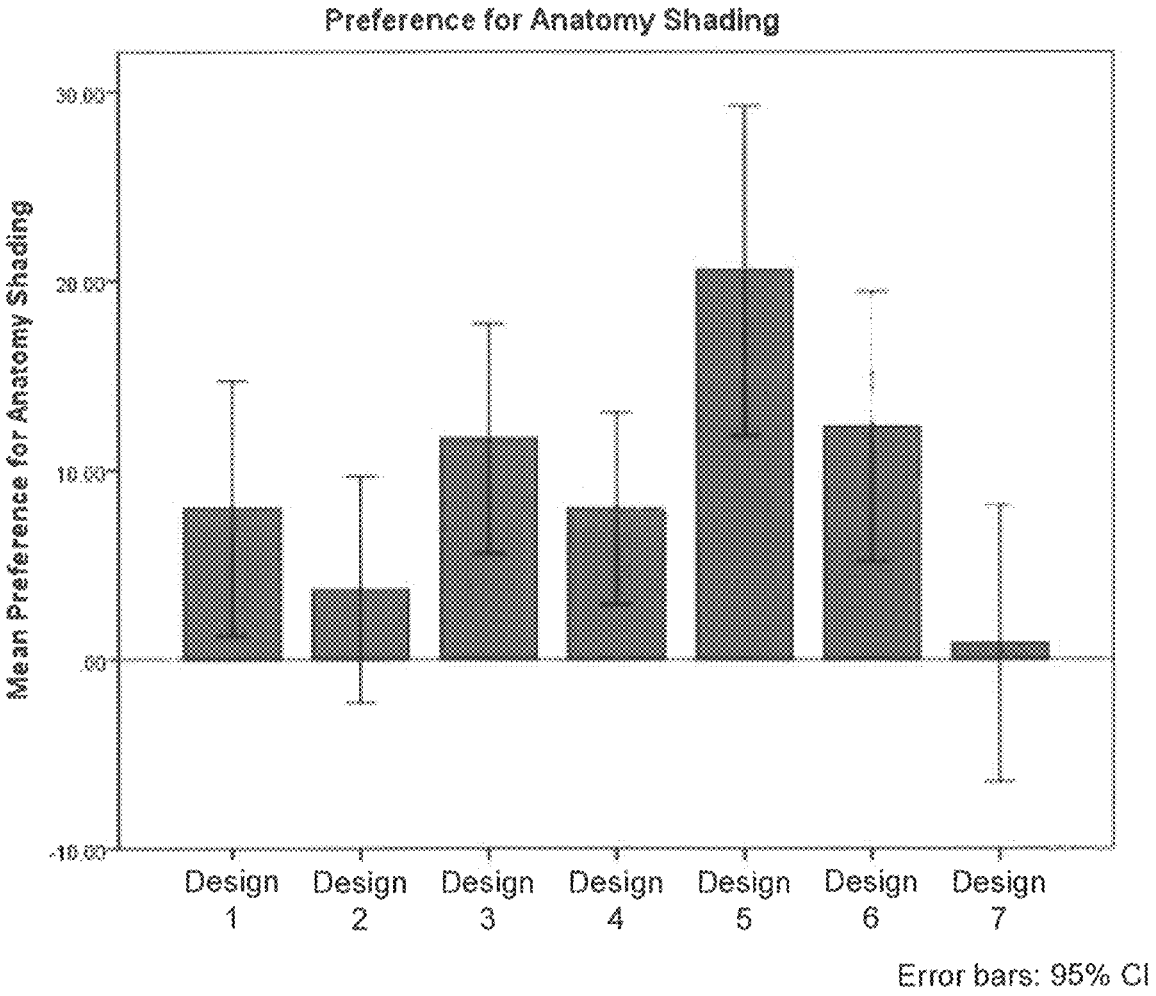
FIG. 16 is a graph that shows the preference for anatomy-shading finishes versus standard finishes.

A further experiment was performed to test whether or not the subjects really do prefer the anatomy shading finish to conventional jean finishes. In each trial, a subject was shown a jean with a standard finish created by VF Corporation and the same jean with an anatomy shading finish. The subject's task was to use a slider to indicate which finish was more attractive and by how much. The data from this experiment, across seven different styles of jeans, are shown in FIG. 16. The bars above the horizontal axis indicate preference for anatomy shading. They axis indicates preference in either direction from 0 to 100. As can be appreciated from FIG. 16, the preference for anatomy-shading finishes over conventional finishes was quite reliable.

As noted above, anatomy shading comprising brightness gradients can be applied to areas other than just the buttocks and rear thighs of jeans. For example, anatomy shading can be provided to the calves and the fronts of the thighs of jeans to emulate ideal proportions of those areas of the body. It is further noted that, while the above discussion has focused on jeans, anatomy shading can be provided on other pants, as well as other garments, which may include underwear, shorts, and shirts. Moreover, while applications for women's garments have been discussed with particularity, it is noted that anatomy shading that emulates ideal male proportions can be provided to men's garments in a similar manner.

What is claimed:

1. A method for providing anatomy shading on a garment, the method comprising:

creating a three-dimensional avatar including a simulated part of a human body that is configured to be covered by the garment, wherein the simulated part of the human body has desired proportions, the simulated part of the human body being a simulated buttocks having a Point A simulating a location of a greater trochanter, a Point B simulating a maximal projection of the mons veneris, a Point C simulating a maximal gluteal projection, and a Point D simulating a location of an anterior superior iliac spine, the simulated buttocks having the following characteristics:

a distance between Point A and Point C being twice a distance between Point A and Point B;

an infragluteal fold of the simulated buttocks extending less than two-thirds a width of a thigh;

a lower spine being angled out from vertical in a range of five degrees to seven degrees; and a V-shaped crease arising in a proximal portion of a gluteal crease;

illuminating the three-dimensional avatar to form shadows on the three-dimensional avatar that highlight contours of the simulated part of the three-dimensional avatar;

generating a three-dimensional brightness gradient that emulates the highlighted contours of the simulated part; and forming a pattern on a garment based upon the three-dimensional brightness gradient that is configured to give observers an impression of the simulated part when the garment covers a part of a human body that has proportions other than the desired proportions.

2. The method of claim 1, wherein forming the pattern comprises creating a two-dimensional template from the three-dimensional brightness gradient and using the two-dimensional template to form the pattern.

3. The method of claim 1, wherein forming the pattern comprises forming the pattern on jeans using a laser process.

4. The method of claim 1, wherein creating the three-dimensional avatar includes the avatar being a three-dimensional computer model.

5. A method for providing anatomy shading on a garment, the method comprising:

creating a three-dimensional avatar including a simulated part of a human body that is configured to be covered by the garment, wherein the simulated part of the human body has desired proportions;

illuminating the three-dimensional avatar to form shadows on the three-dimensional avatar that highlight contours of the simulated part of the three-dimensional avatar;

generating a three-dimensional brightness gradient that emulates the highlighted contours of the simulated part, generating the three-dimensional brightness gradient includes the three-dimensional brightness gradient having a first bright spot configured to be positioned over a central region of each buttock, a dark spot configured to be positioned over each infragluteal fold, and a second bright spot configured to be positioned over an upper rear portion of each thigh, wherein:

the first bright spots are vertically located between 4.5 inches and 7.5 inches above a crotch level and horizontally located between 1.5 inches and 4.5 inches from a center seam;

the dark spots are vertically located between 0 inches and 3 inches above the crotch level and horizontally located between 3.5 inches and 6 inches from the center seam; and the second bright spots are vertically located between 1.5 inches and 4.5 inches below the crotch level and horizontally located between 5 inches and 8 inches from the center seam; and forming a pattern on a garment based upon the three-dimensional brightness gradient that is configured to give observers an impression of the simulated part when the garment covers a part of a human body that has proportions other than the desired proportions.

6. The method of claim 5, wherein generating the three-dimensional brightness gradient includes each of the first bright spots and the second bright spots having a peak magnitude in a range of 2.5 to 6 $cd/m^2$.

7. The method of claim 5, wherein forming the pattern comprises creating a two-dimensional template from the three-dimensional brightness gradient and using the two-dimensional template to form the pattern.

8. The method of claim 5, wherein forming the pattern comprises forming the pattern on jeans using a laser process.

9. The method of claim 5, wherein creating the three-dimensional avatar includes the avatar being a three-dimensional computer model.

* * * * *